US009116473B2

(12) United States Patent
Sakai

(10) Patent No.: US 9,116,473 B2
(45) Date of Patent: Aug. 25, 2015

(54) FIXING DEVICE WITH MEANDERING PREVENTION MEMBERS AND IMAGE FORMING APPARATUS INCLUDING THE SAME

(71) Applicant: Konica Minolta, Inc., Chiyoda-ku (JP)

(72) Inventor: Toshiyuki Sakai, Shinshiro (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/966,390

(22) Filed: Aug. 14, 2013

(65) Prior Publication Data

US 2014/0056626 A1 Feb. 27, 2014

(30) Foreign Application Priority Data

Aug. 24, 2012 (JP) ..... 2012-184757

(51) Int. Cl.
*G03G 15/20* (2006.01)

(52) U.S. Cl.
CPC ..... *G03G 15/2017* (2013.01); *G03G 15/2053* (2013.01); *G03G 2215/00151* (2013.01); *G03G 2215/2035* (2013.01)

(58) Field of Classification Search
CPC ..... G03G 2215/00151; G03G 15/2017; G03G 15/2053; G03G 2215/2035
USPC ..... 399/329, 67
See application file for complete search history.

(56) References Cited

U.S. PATENT DOCUMENTS 7,242,898 B2 * 7/2007 Kawahata ..... 399/329
7,418,229 B2 * 8/2008 Aruga et al. ..... 399/329
7,734,236 B2 * 6/2010 Sakuma ..... 399/302
7,810,633 B2 * 10/2010 Okamoto et al. ..... 198/806
2009/0087231 A1 * 4/2009 Masaki et al. ..... 399/308
2011/0299903 A1 12/2011 Yamamoto et al.
2014/0334857 A1 * 11/2014 Hayase ..... 399/329

FOREIGN PATENT DOCUMENTS

JP 2009-109997 A 5/2009
JP 2010-249917 A 11/2010
JP 2011-253055 A 12/2011

OTHER PUBLICATIONS

English Translation of Okuno et al., Fixing Device, and Image Forming Apparatus having the Same, Nov. 4, 2010. Japanese Patent Abstracts. JP2010-249917.*

* cited by examiner

*Primary Examiner* — Clayton E Laballe
*Assistant Examiner* — Trevor J Bervik
(74) *Attorney, Agent, or Firm* — Buchanan Ingersoll & Rooney PC

(57) ABSTRACT

A fixing device employing resistance heating system includes: a fixing roller being loosely inserted into an endless fixing belt; a pressure member being in pressure-contact with the fixing belt to form fixing nip; meandering prevention members preventing the fixing belt from meandering; prevention member holders holding the meandering prevention members for rotation independently from the fixing roller. Each meandering prevention member has rotation center inside circle, where, when seen in rotation axis direction of the fixing roller, the circle has center coincident with midpoint between two focal points of ellipse approximating belt rotation path of the fixing belt, and has radius equal to distance from the center of the circle to straight line passing through rotation center of the fixing roller and center of the nip in rotational direction of the fixing roller.

11 Claims, 11 Drawing Sheets

FIXING DEVICE WITH MEANDERING PREVENTION MEMBERS AND IMAGE FORMING APPARATUS INCLUDING THE SAME

CROSS-REFERENCE TO RELATED APPLICATIONS

This application is based on application No. 2012-184757 filed in Japan, the contents of which are hereby incorporated by reference.

BACKGROUND OF THE INVENTION (1) Field of the Invention

The present invention relates to a fixing device and an image forming apparatus, and particularly to an art of preventing meandering of a fixing belt included in a fixing device employing a resistance heating system.

(2) Related Art

There has been known the structure of an image forming apparatus employing an electronic photography system in which an endless belt-shaped fixing rotary member (hereinafter, fixing belt) is used in order to improve the thermal efficiency for thermal fixing of a toner image carried on a recording sheet. By reducing the thickness of the fixing belt to decrease the thermal capacity thereof, it is possible to reduce the warming-up period and the thermal efficiency during warming-up and fixing. Furthermore, in the case where the fixing belt also functions as a heat source in a fixing device employing an electromagnetic induction heating system, a resistance heating system, and so on, a small thermal loss occurs because a thermal conduction path from the heat source to a recording sheet is extremely short.

In order to thermally fix a toner image onto a recording sheet, a fixing nip needs to be formed by bringing a pressure roller into pressure-contact with the fixing belt. Accordingly, a pressing member such as a fixing roller is brought into pressure-contact with a region on the inner circumferential surface of the fixing belt which corresponds to the fixing nip. In order to reduce a thermal loss resulting from thermal conduction from the fixing belt to the pressing member, it is effective to adopt the structure in which the fixing belt and the pressing member are loosely fit together by providing a space therebetween. Air with high thermal insulation properties enters the space and to exist between the fixing belt and the pressing member, and this effectively reduces the thermal loss resulting from the thermal conduction as described above.

However, according to the above structure in which the fixing belt and the pressing member are loosely fit together, there occurs a problem that the fixing belt meanders in the rotation axis direction thereof to cause belt deflection because of not being tightly held. Especially if the fixing belt continues to deflect in the same direction on the rotation axis thereof, there might occur faulty fixing, damage on the fixing device, drop-off of the fixing device, and so on. Therefore, there has been proposed a countermeasure of providing a meandering prevention member that prevents the fixing belt from meandering so as to face each side of the fixing belt in the width direction of the fixing belt.

For example, Japanese Patent Application Publication No. 2010-249917 has proposed an art with respect to a fixing device employing the electromagnetic induction heating system. According to this art, a pair of meandering prevention members, which are held so as to independently rotatable relative to a fixing roller, are in abutment with only a part of the fixing belt where a fixing nip is not formed when seen in the rotation axis direction of the fixing belt. With this structure, the meandering prevention members are driven by the fixing belt to rotate, differently from the case where the meandering prevention members are fastened together with the fixing roller. This minimizes the difference in peripheral speed between the fixing belt and the meandering prevention members at the abutment position therebetween. Therefore, it is possible to prevent abrasion, shaving, and so on due to sliding contact of the fixing belt with the meandering prevention members.

Also, while the peripheral speed of the fixing belt is constant even at the fixing nip, irrespective of the distance from the rotation axis of the fixing belt, the peripheral speed of the meandering prevention members varies in accordance with the distance of the rotation center thereof. By not bringing the meandering prevention member into abutment with the fixing belt at the fixing nip which is especially close to the rotation axis of the fixing belt, it is possible to further reduce the difference in peripheral speed between the meandering prevention member and the fixing belt at the abutment position therebetween.

According to the fixing device employing the electromagnetic induction heating system, the fixing belt receives an external force only at the fixing nip. Accordingly, the fixing belt has a cross section perpendicular to the rotation axis of the fixing belt that forms a rotation path in the shape of a substantial circle or an ellipse excepting the fixing nip. The fixing belt runs on this rotation path. Also, this circle or ellipse has its center and focal points on a straight line connecting the rotation center of a pressure roller and the rotation center of a fixing roller on the cross section of the fixing belt perpendicular to the rotation axis. This straight line is hereinafter referred to as straight line in the pressure direction.

Compared with this, according to a fixing device employing the resistance heating system, since electric power needs to be fed to a resistance heating layer, an electrode part needs to be provided at each side of a fixing belt in the width direction of the fixing belt to bring a power feeding brush into abutment with the electrode part. In the case where the power feeding brush is in abutment with the electrode part at a position which is not positioned on the straight line in the pressure direction, the fixing belt runs on a rotation path in the shape of a substantial ellipse formed by the cross section perpendicular to the rotation axis. However, a straight line connecting two focal points of this substantial ellipse is not coincident with the straight line in the pressure direction due to a pressing force of the power feeding brush. For this reason, even if the above conventional art is applied with no modification, it is impossible to sufficiently reduce the difference in peripheral speed between the fixing belt and meandering prevention members.

According to the fixing device employing the resistance heating system, however, when the fixing belt meanders, the electrode part of the fixing belt is brought into pressure contact and sliding contact with the meandering prevention member, and the electrode part deforms to uplift. This causes instantaneous defective continuity at a part of the electrode part that in abutment with the power feeding brush, and results in a large difference in electrical potential to cause a spark discharge. The electrode part melts or is damaged due to heat and shock of the spark discharge, and as a result the outer surface of the electrode part becomes uneven. Since the surface flatness of the electrode part is not uniform in this way, the sliding contact state between the power feeding brush and the electrode part becomes destabilized. This hinders a stable power feeding to the electrode part and thereby the resistance heating layer. Furthermore, a spark discharge frequently occurs, and accordingly the durability of the electrode part deteriorates and thereby the life time of the fixing belt extremely decreases. Therefore, even in the fixing device employing the resistance heating system, prevention of meandering of the fixing belt is a problem absolutely to be solved.

SUMMARY OF THE INVENTION

The present invention was made in view of the above problem, and aims to provide a fixing device employing the resistance heating system and including meandering prevention members having less abrasion, shaving, and the like due to sliding contact with a fixing belt, and an image forming apparatus including the fixing device.

In order to achieve the above aim, the present invention provides a fixing device including: an endless fixing belt that includes a resistance heating layer that generates Joule heat when electric power is fed thereto and a pair of electrode parts that feed electric power to the resistance heating layer; a pair of power feeding members that are each in abutment with an outer circumferential surface of a corresponding one of the electrode parts to feed electric power to the resistance heating layer through the electrode part; a fixing roller that is loosely inserted into the fixing belt; a pressure member that is in pressure-contact with an outer circumferential surface of the fixing belt to form a fixing nip; a pair of meandering prevention members that are each provided facing a corresponding one of sides of the fixing belt in a width direction of the fixing belt, and prevent the fixing belt from meandering in the width direction; and a pair of prevention member holders that each hold a corresponding one of the meandering prevention members, such that the meandering prevention member rotates independently from the fixing roller, wherein the meandering prevention members are each held so as to have a rotation center positioned inside a circle, where, when seen in a rotation axis direction of the fixing roller, the circle has a center coincident with a midpoint between two focal points of an ellipse approximating a belt rotation path of the fixing belt, and has a radius equal to a distance from the center of the circle to a straight line passing through a rotation center of the fixing roller and a center of the fixing nip in a rotational direction of the fixing roller.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF PREFERRED EMBODIMENTS

The following describes an embodiment of a fixing device and an image forming apparatus relating to the present invention, with reference to the drawings.

[1] Structure of Image Forming Apparatus

Firstly, description is given on the structure of the image forming apparatus relating to an embodiment of the present invention.

Figure 1:
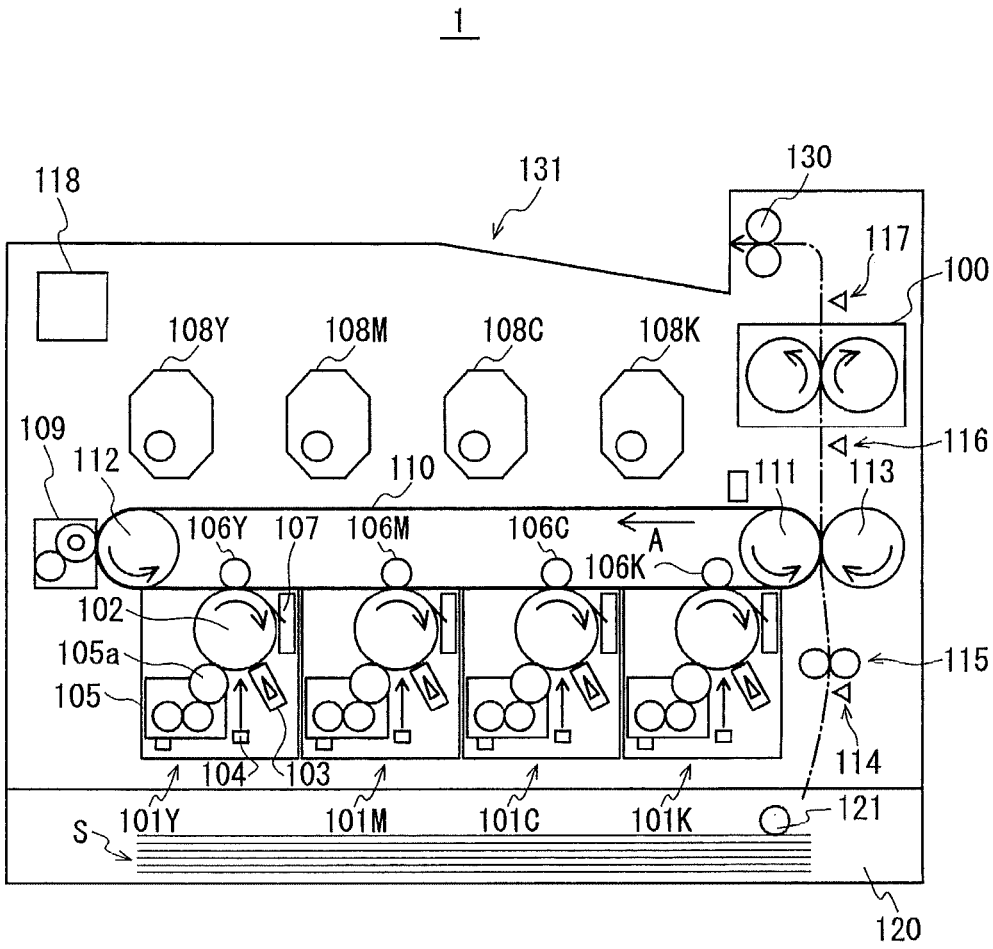
FIG. 1 shows the structure of main elements of an image forming apparatus relating to an embodiment of the present invention.

FIG. 1 shows the structure of main elements of the image forming apparatus relating to the embodiment of the present invention. An image forming apparatus 1 is a color printing apparatus employing a so-called intermediate transfer system. As shown in FIG. 1, the image forming apparatus 1 includes image forming units 101Y to 101K for forming toner images of yellow (Y), magenta (M), cyan (C), and black (K) colors, respectively. The image forming units 101Y to 101K have the same structure, and accordingly description is given on only the image forming unit 101Y as a representative of the image forming units 101Y to 101K. In order to perform image formation, a charger 103 uniformly charges the outer circumferential surface of a cylindrical photosensitive drum 102 such that the outer circumferential surface has a predetermined potential. Then, an exposure device 104 performs exposure on the outer circumferential surface of the cylindrical photosensitive drum 102, which has been uniformly charged, in accordance with an image signal of an original document. As a result, an electrostatic latent image is formed.

A developer 105 supplies toner of Y color supplied from a toner cartridge 108Y (each of respective toners of MCK colors supplied from toner cartridges 108M to 108K) on the outer circumferential surface of the photosensitive drum 102 by a developing roller 105*a* to which a developing bias is applied, so as to develop an electrostatic latent image to form a visible toner image. Each of primary transfer rollers 106Y to 106K to which a primary transfer voltage is applied electrostatically absorbs toners, so as to primarily transfer the visible toner image from the outer circumferential surface of the photosensitive drum 102 onto an intermediate transfer belt 110. After the visible toner image is primarily transferred onto the intermediate transfer belt 110, toners remaining on the outer circumferential surface of the photosensitive drum 102 are removed by a cleaner 107.

The intermediate transfer belt 110 stretches and lays on a driving roller 111 and a driven roller 112. The driving roller 111 is driven by a main motor which is not illustrated, and the intermediate transfer belt 110 is driven to rotate by a force of friction with the driving roller 111. While the intermediate transfer belt 110 rotates in a direction indicated by an arrow A, the respective toner images of the YMCK colors, which are formed by the image forming units 101Y to 101K, respectively, are primarily transferred onto the intermediate transfer belt 110 so as to be layered. As a result, a color toner image is formed. The driven roller 112 is driven to rotate by a force of friction with the intermediate transfer belt 110 during rotation.

While the above operations are performed, a pickup roller 121 picks up and sends out recording sheets S housed in a paper feed cassette 120 piece by piece, and the recording sheets S are further conveyed, through a pair of timing rollers 115, to a secondary transfer nip formed by the driving roller 111 and a secondary transfer roller 113. In the secondary transfer nip, the secondary transfer roller 113 is brought into pressure-contact with the driving roller 111 via the intermediate transfer belt 110, and also a secondary transfer bias is applied to the secondary transfer roller 113. When each of the recording sheets S passes through the secondary transfer nip, a color toner image carried on the intermediate transfer belt 110 is electrostatically (secondarily) transferred onto the recording sheet S.

Note that a rotation driving force is transmitted from the main motor to the pair of timing rollers 115 via a timing clutch which is not illustrated. The pair of timing rollers 115 adjusts a timing of conveying each of the recording sheets S by switching the timing clutch between ON and OFF, such that the toner image carried on the intermediate transfer belt 110 is transferred onto a desired position on the recording sheet S. Also, a pre-timing sensor 114 is provided on a conveyance path of the recording sheet S from the pickup roller 121 to the pair of timing rollers 115, and detects passing of the recording sheet S. A fixing loop sensor 116 detects passing of the recording sheet S on which the toner image is carried. Then, the recording sheet S is conveyed to a fixing device 100.

The fixing device 100 is a fixing device employing the resistance heating system. The fixing device 100 includes a fixing belt that heats a toner image and a pressure roller that is brought into pressure-contact with the fixing belt to form a fixing nip, as described later. The recording sheet S is fed through the fixing nip, and as a result the toner image is fused and pressed onto the recording sheet S. Then, a paper ejection sensor 117 detects ejection of the recording sheet S from the fixing device 100. The recording sheet S is ejected onto an ejection tray 131 through a paper ejection roller 130. Also, toners remaining on the intermediate transfer belt 110 after the secondary transfer are conveyed in the direction indicated by the arrow A, and then the remaining toners are removed by a cleaner 109.

The control unit 118 collectively controls the operations of the image forming apparatus 1. Upon receiving an image forming job from other apparatus via a communication unit, the control unit 118 controls the fixing device 100 and the image forming units 101Y to 101K, and so on to perform image forming operations in accordance with the image forming job. Also, the control unit 118 monitors temperature at each of the elements included in the image forming apparatus 1 by a temperature sensor which is not illustrated, and controls a cooling fan which is not illustrated to prevent overheat of each of the elements included in the image forming apparatus 1.

[2] Structure of Fixing Device 100

Next, description is given on the structure of the fixing device 100 relating to the present embodiment.

Figure 2:
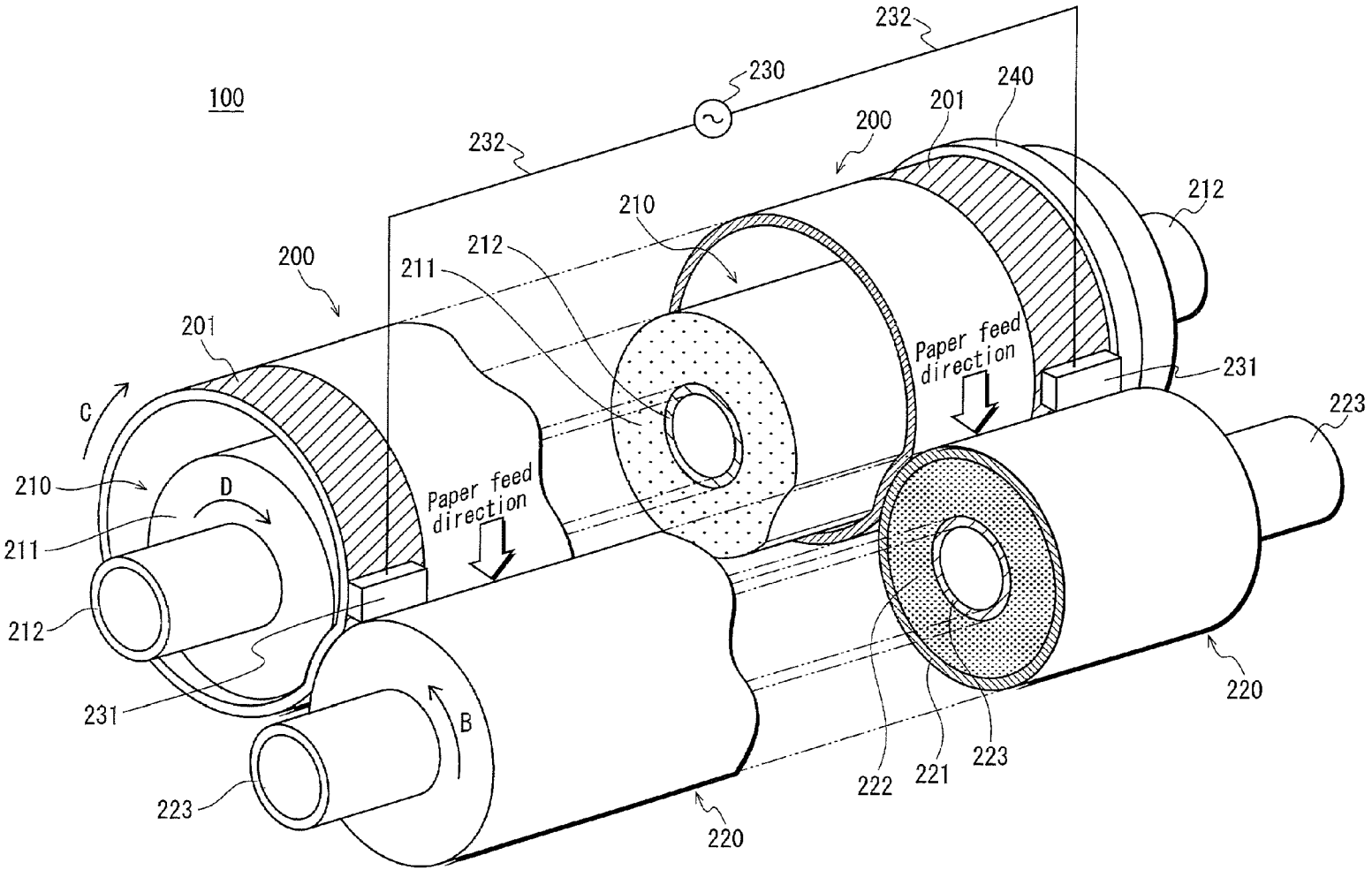
FIG. 2 is a partially cutaway perspective view showing the structure of main elements of a fixing device 100.

FIG. 2 is a partially cutaway perspective view showing the structure of main elements of a fixing device 100. As shown in FIG. 2, the fixing device 100 includes a fixing belt 200 that is elastically deformable and endless, a fixing roller 210 into which the fixing belt 200 is loosely inserted, and a pressure roller 220 that is brought into pressure-contact with the fixing roller 210 via the fixing belt 200. Also, in order to cause a resistance heating layer which is not illustrated to generate joule heat, the fixing belt 200 receives alternating electric current supplied from an alternating current power source which is not illustrated. A fixing nip is formed due to pressure-contact between the fixing belt 200 and the pressure roller 220. A recording sheet S is fed through the fixing nip, and as a result a toner image is thermally fixed onto the recording sheet S. Note that, in order to increase the thermal efficiency, the recording sheet S is fed through the fixing nip such that a surface of the recording sheet S on which an unfixed toner image is carried on is brought into abutment with the fixing belt 200.

Also, the fixing belt 200 has an electrode part 201 on each side thereof in the width direction thereof. The electrode parts 201 each come into abutment with a power feeding brush 231 which is connected to an alternating current power source 230 via a conductive line (harness) 232. This enables application of alternating electric current to the resistance heating layer of the fixing belt 200. The power feeding brush 231 comes into abutment with the fixing belt 200 immediately upstream of a fixing nip in the rotation direction of the fixing belt 200. This stabilizes the position (deformed state) of the fixing belt 200 while being driven to rotate. Furthermore, the fixing device 100 includes a pair of meandering prevention members 240 for preventing the fixing belt 200 from meandering, which are described later. The meandering prevention members 240 are held by a pair of prevention member holders, which are described later.

The fixing belt 200 is an endless belt, and also has a cylindrical shape before assembly. The fixing belt 200 has an outer diameter of 41 mm and an inner diameter of 40 mm, for example. The fixing belt 200 has shape-retaining properties, and specifically, elastically deforms in response to application of a certain amount of external force in a radius direction thereof. When the application of the external force stops in such a deformed state, the fixing belt 200 restores to its original shape owing to its resilience. In the present embodiment, the pressure roller 220 and the power feeding brushes 231 are brought into pressure-contact with the outer circumferential surface of the fixing belt 200, and thereby the fixing belt 200 deforms to have an elliptical cross section perpendicular to the rotation axis direction thereof. In other words, the fixing belt 200 runs on a rotation path in the shape of an ellipse, which is formed by the cross section of the fixing belt 200. This ellipse is determined in accordance with the dimension of the fixing belt 200, the elastic restoring force, the pressure contact force of each of the pressure roller 220 and the power feeding brushes 231, and so on.

Figure 3:
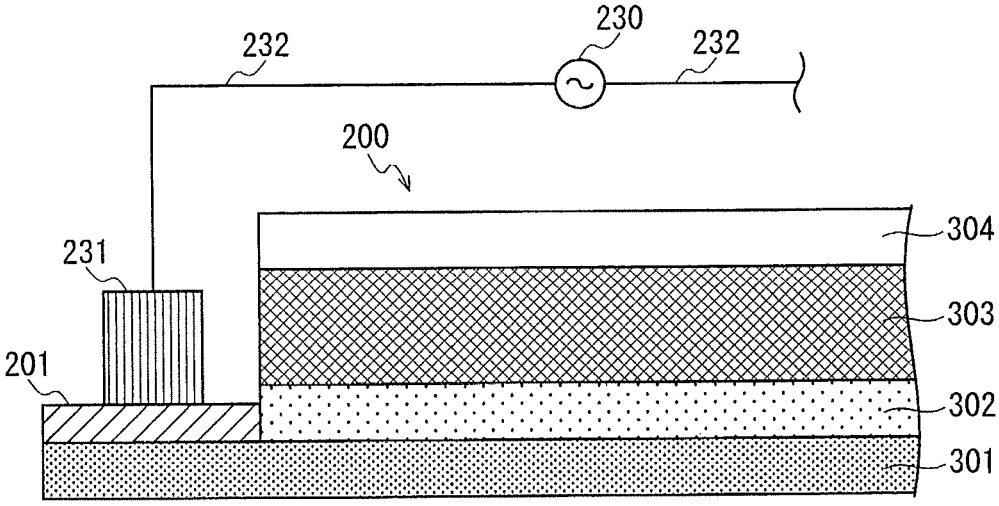
FIG. 3 is a cross-sectional view showing the layer structure of the fixing belt 200.

The fixing belt 200 has the multilayer structure in which the resistance heating layer, which is described above, is included. FIG. 3 is a cross-sectional view showing the layer structure of the fixing belt 200. As shown in FIG. 3, the fixing belt 200 has the structure in which an insulator layer 302, an elastic layer 303, and a release layer 304 that are layered on a resistance heating layer 301 in a stated order. The electrode part 201, which is provided at each side of the fixing belt 200 in the width direction, is electrically connected to the resistance heating layer 301. Alternating electric current is applied from the feeding brush 231 to the resistance heating layer 301 via the electrode parts 201, thereby causing the resistance heating layer 301 to generate joule heat.

The resistance heating layer 301 is adjusted so as to have a predetermined electrical resistivity due to dispersion of a conductive filler in a resin material. As the resin material, a heat-resistant resin material is preferable such as polyimide (PI), polyphenylene sulfide (PPS), polyether ether ketone (PEEK). PI has the highest heat-resistance among these heat-resistant resin materials.

Also, as the conductive filler, the following powders should be employed: metal powders such as silver (Ag), copper (Cu), aluminum (Al), magnesium (Mg), and nickel (Ni); powders of carbonic compound such as graphite, carbon black, carbon nanotube, carbon nanofiber, and carbon microcoil; or powders of super ionic conductor as an inorganic compound such as silver iodide (AgI) and copper iodide (CuI). Alternatively, two or more types among these powders may be mixed and dispersed in the resin material. The conductive filler is desirably fibrous in order to increase the contact probability between fillers with a small dispersion amount to easily cause percolation.

Carbonic compound and super ionic conductor each has an NTC (Negative Temperature Coefficient) in which as a temperature increases, a volume resistivity decreases. Accordingly, carbonic compound and super ionic conductor are each utilizable for causing the resistance heating layer 301 to have NTC properties. Also, super ionic conductor is effective because of not deteriorating the mechanical strength of the resistance heating layer 301. However, with use of only carbonic compound or only super ionic conductor, it is difficult to adjust the electrical resistivity of the resistance heating layer 301 to a heat value appropriate for the fixing device 100 such as an approximate range of 500 W to 1500 W in commercial power source. Accordingly, it is desirable to use metal powders in combination with carbonic compound or super ionic conductor, and thereby to adjust the electrical resistivity of the resistance heating layer 301.

The metal powders are preferably silver or nickel that is in a form of a needle or a flake, and should have a particle size within a range of 0.01 μm to 10 μm. With this structure, the metal powders are linearly tangled with carbonic compound or super ionic conductor, and accordingly, it is possible to mold the resistance heating layer 301 having a uniform volume resistivity. As the conductive filler to be dispersed in the heat-resistant resin, metal powders preferably fall within a range of 50% by weight to 300% by weight of the heat-resistant resin, and carbonic compound and super ionic conductor each preferably fall within a range of 5% by weight to 100% by weight of the heat-resistant resin. Also, carbonic compound preferably has a volume fraction of 20% by volume to 60% by volume. In the case where the amount of metal powders is too much, the electrical resistivity of the resistance heating layer 301 decreases too much, and as a result electric current and electric power to be applied to the resistance heating layer 301 exceed the power source allowable range. For this reason, too much amount of metal powders is hard to use. On the contrary, in the case where the amount of metal powders is too less, the electrical resistivity of the resistance heating layer 301 increases too much, and as a result desired electric power cannot be obtained. For this reason, too less amount of metal powders is also hard to use.

The resistance heating layer 301 desirably has an approximate thickness of 5 μm to 200 μm. It is clear that the electrical resistivity of the resistance heating layer 301 should be determined in accordance with voltage and electric power to be applied, the thickness of the resistance heating layer 301, the radius and length of the fixing belt 200, and so on. Furthermore, the resistance heating layer 301 should have an electrical resistivity of $1.0\times10^{-6}$ Ω·m to $1.0\times10^{-2}$ Ω·m, for example. The resistance heating layer 301 more preferably has an electrical resistivity of $1.0\times10^{-5}$ Ω·m to $5.0\times10^{-3}$ Ω·m. Also, in order to adjust the electrical resistivity of the resistance heating layer 301, conductive particles may be added such as a metal alloy and an intermetallic compound. Furthermore, in order to improve the mechanical strength of the resistance heating layer 301, glass fiber, whisker, titanium dioxide ($TiO_2$), potassium titanate ($K_4O_4Ti$), or the like may be added. Moreover, in order to improve the thermal conductivity of the resistance heating layer 301, aluminum nitride (AlN), aluminium oxide ($Al_2O_3$), or the like may be added.

The resistance heating layer 301 is manufactured, by uniformly dispersing a conductive filler in polyimide varnish which results from polymerizing aromatic tetracarboxylic dianhydride and aromatic diamine in an organic solvent, applying the polyimide varnish to a mold, and performing imide conversion. In consideration of the stability in manufacture of the resistance heating layer 301, it is effective to add an imidation agent, a coupling agent, a surface-activating agent, and an antifoaming agent.

The insulator layer 302 reinforces the resistance heating layer 301 whose strength has deteriorated due to dispersion of the conductive filler, and also ensures insulation between the resistance heating layer 301 and other layers. Due to this, the insulator layer 302 may be omitted in the case where the resistance heating layer 301 has a sufficient strength and insulation does not need to be ensured between the resistance heating layer 301 and other layers. The insulator layer 302 is formed from an insulating resin such as PI and PPS. Note that, by using, as the material for the insulator layer 302, the same type of material as the resistance heating layer 301, the insulator layer 302 has improved adhesion properties to the resistance heating layer 301. The insulator layer 302 desirably has a thickness of 5 μm to 100 μm.

The elastic layer 303 is a layer for preventing uneven burnish in a color image where the toner thickness differs for each color. The elastic layer 303 is formed from an excellent heat-resistant elastic material such as a silicone rubber and a fluoro rubber, and desirably has a thickness of 100 μm to 300 μm.

The release layer 304 is provided on the outermost circumference of the fixing belt. The release layer 304 desirably has the release properties of fluorine tube, fluorine coating, or the like such as perfluoroalkoxy (PFA), polytetrafluoroethylene (PTFE), and ethylene tetrafluoroethylene (ETFE). Also, the release layer 304 may be formed from a conductive material. As the fluorine tube, the product manufactured by Du Pont-Mitsui Fluorochemicals Co., Ltd. may be used such as PFA350-J, 451HP-J, and 951HP Plus. The release layer 304 should have an angle of contact of 90° or more with water, and more preferably should have an angle of contact of 110° or more with water. The release layer 304 desirably has a surface roughness such that the center line average roughness (Ra)

falls within a range of 0.01 μm to 50 μm. The release layer 304 desirably has a thickness of 5 μm to 100 μm, for example.

The electrode part 201 is layered on the whole circumference on each side of the fixing belt 200 in the width direction of the fixing belt 200. With this shape, when electrical current is applied to the electrode part 201, the electric current is uniformly distributed on the entire resistance heating layer 301, thereby achieving uniform heat generation.

The electrode part 201 is desirably formed from a metal having a uniform electrical resistance in the circumferential direction of the fixing belt 200 and having a low electrical resistivity. The electrode part 201 should be formed from gold (Au), silver, copper, aluminum, zinc (Zn), tungsten (W), nickel, brass, phosphor bronze, or stainless used steel (SUS). The electrode part 201 is desirably layered on the resistance heating layer 301 with use of a method such as chemical plating and electroplating. In order for the electrode part 201 to ensure the adhesion properties to the resistance heating layer 301, a adhesion surface of the resistance heating layer 301 should be roughened beforehand so as to have a surface roughness in which the center line average roughness (Ra) falls within a range of 0.1 μm an to 5 μm.

In the case where an electrode is formed directly on the resistance heating layer 301, electroplating should be performed after chemical plating. Particularly, copper and nickel are desirable for plating. More desirably, nickel electroplating should be performed after chemical copper plating or copper electroplating. Alternatively, a copper foil or a nickel foil may be adhered by applying a conductive adhesive. Further alternatively, a conductive ink or a conductive paste may be coated. Yet alternatively, a thin plate member formed from a ring-shaped metal, such as SUS and nickel, may be integrally formed by insert-molding.

Now returning to FIG. 2, the fixing roller 210 is formed by layering an elastic layer 211 on the outer circumferential surface of an elongated metal core 212, and is arranged inside a rotation path of the fixing belt 200 on which the fixing belt 200 runs. This rotation path is hereinafter referred to as belt rotation path.

The metal core 212 functioning as a shaft is formed from aluminum, SUS, or the like having a diameter of 18 mm, for example. The metal core 212 may be formed from a hollow pipe-shaped member or a solid member, having a thickness of 0.1 mm to 10 mm. Alternatively, the metal core 212 may be formed from a member in other shape having a cross section whose shape is for example a wheel with spokes. The metal core 212 is rotatably born at each side of the fixing belt 200 in the width direction by a prevention member holder (not illustrated) via a bearing, which is described later.

The elastic layer 211 is desirably formed from a heat-resistant material such as a silicone rubber and a fluorine rubber. Also, the elastic layer 211 may be formed from a solid material. However, in the case where the elastic layer 211 is formed from a foam sponge material, the elastic layer 211 has improved thermal insulation properties, and this increases the thermal efficiency of the fixing device 100. Furthermore, in the case where the elastic layer 211 has a double-layered structure in which a solid material is layered on a sponge material, this increases the durability of the elastic layer 211. The elastic layer 211 desirably has a thickness of 1 mm to 20 mm.

The fixing roller 210 has an outer diameter smaller than an inner diameter of the fixing belt 200, and desirably has an outer diameter of 20 mm to 100 mm, for example. Also, the fixing roller 210 and the fixing belt 200 are in contact with each other at a part of the inner circumferential surface of the fixing belt 200 which corresponds to the fixing nip. The fixing roller 210 and the fixing belt 200 have a space therebetween other than at the part which corresponds to the fixing nip.

With this structure, compared with a structure in which the fixing belt 200 is brought into close contact with the fixing roller 210, a heat conduction area, where heat generated from the fixing belt 200 is conducted to the fixing roller 210, is small. This reduces the heat conduction loss that part of heat generated from the fixing belt 200 is conducted through the metal core 212 of the fixing roller 210, and is conducted to a housing of the fixing device 100 via each side of the metal core 212 and the bearings, to be finally lost. Therefore, it is possible to realize an excellent thermal efficiency.

The pressure roller 220 is formed by layering, on the circumference of an elongated metal core 223, a release layer 221 via an elastic layer 222. The pressure roller 220 is provided outside the belt rotation path of the fixing belt 200. The pressure roller 220 has the structure in which each side of the metal core 223 in the width direction of the metal core 223 is rotatably born by a forcing mechanism which is not illustrated via a bearing or the like. In response to application of a force by the forcing mechanism, the pressure roller 220 presses the fixing roller 210 via the fixing belt 200 from the outside of the fixing belt 200, such that a fixing nip N is formed between the surface of the pressure roller 220 and the surface of the fixing belt 200.

In response to application of a driving force by a drive motor which is not illustrated, the pressure roller 220 is driven to rotate in a direction indicated by an arrow B. The fixing belt 200 is driven by the pressure roller 220 to circularly run in a direction indicated by an arrow C, and the fixing roller 210 is driven to rotate in a direction indicated by an arrow D. Note that the fixing roller 210 may be a driving side, and the fixing belt 200 and the pressure roller 220 may be a driven side. The pressure roller 220 desirably has an outer diameter of 20 mm to 100 mm.

The metal core 223 is for example a hollow pipe-shaped member formed from a metal such as aluminum and iron (Fe), and has an outer diameter of 30 mm for example. Also, the metal core 223 desirably has a thickness of 0.1 mm to 10 mm. Note that the metal core 223 may be solid and cylindrical, or may have a cross section whose shape is for example a wheel with spokes. The elastic layer 222 is for example formed from an excellent heat-resistant rubber such as a silicone rubber and a fluorine rubber, a foam material of such an excellent heat-resistant rubber, or the like. The elastic layer 222 desirably has a thickness of 1 mm to 20 mm. The release layer 221 is formed from a fluorine resin tube or a fluorine resin coating such as PFA and PFTE. The release layer 221 may have conductivity for preventing toner offset due to charging. The release layer 221 desirably has a thickness of 5 μm to 100 μm.

The power feeding brushes 231 are each a rectangular parallelepiped block having dimensions of 10 mm long, 5 mm wide, and 7 mm high, and is a so-called carbon brush formed from a material having slidability and conductivity such as a copper-graphite material and a carbon-graphite material. The power feeding brushes 231 are each forced by an elastic member such as a spring, towards a direction from the outer circumference to the inner circumference of the fixing belt 200. This force brings the power feeding brush 231 into pressure-contact with the electrode part 201. The power feeding brush 231 desirably has a lower hardness than the electrode part 201. This is because a thin film is formed on the outer circumferential surface of the electrode part 201 by abrasion powders resulting from abrasion of the power feeding brush 231 due to sliding contact, and this achieves a more stable power feed state. Also, by caving a contact surface of the power feeding brush 231 with the electrode part 201 so as to be along the outer circumferential surface of the electrode part 201, it is possible to increase a contact area between the power feeding brush 231 and the electrode part 201, thereby decreasing the current density passing through the contact surface.

[3] Structure of Meandering Prevention Members 240

Next, description is given on the structure of the meandering prevention members 240.

The meandering prevention members 240 are members that prevent the fixing belt 200 from becoming displaced (meandering) by abutment with the sides of the fixing belt 200 in the width direction. Characteristically, in order to reduce abrasion, damage, or the like of the fixing belt 200 due to sliding contact, the meandering prevention members 240 each have a rotation center on a position different from the rotation center of the fixing roller 210. For this reason, the pair of meandering prevention members 240, which are mirror symmetrical, are provided facing the sides of the fixing belt 200, respectively.

Figure 4:
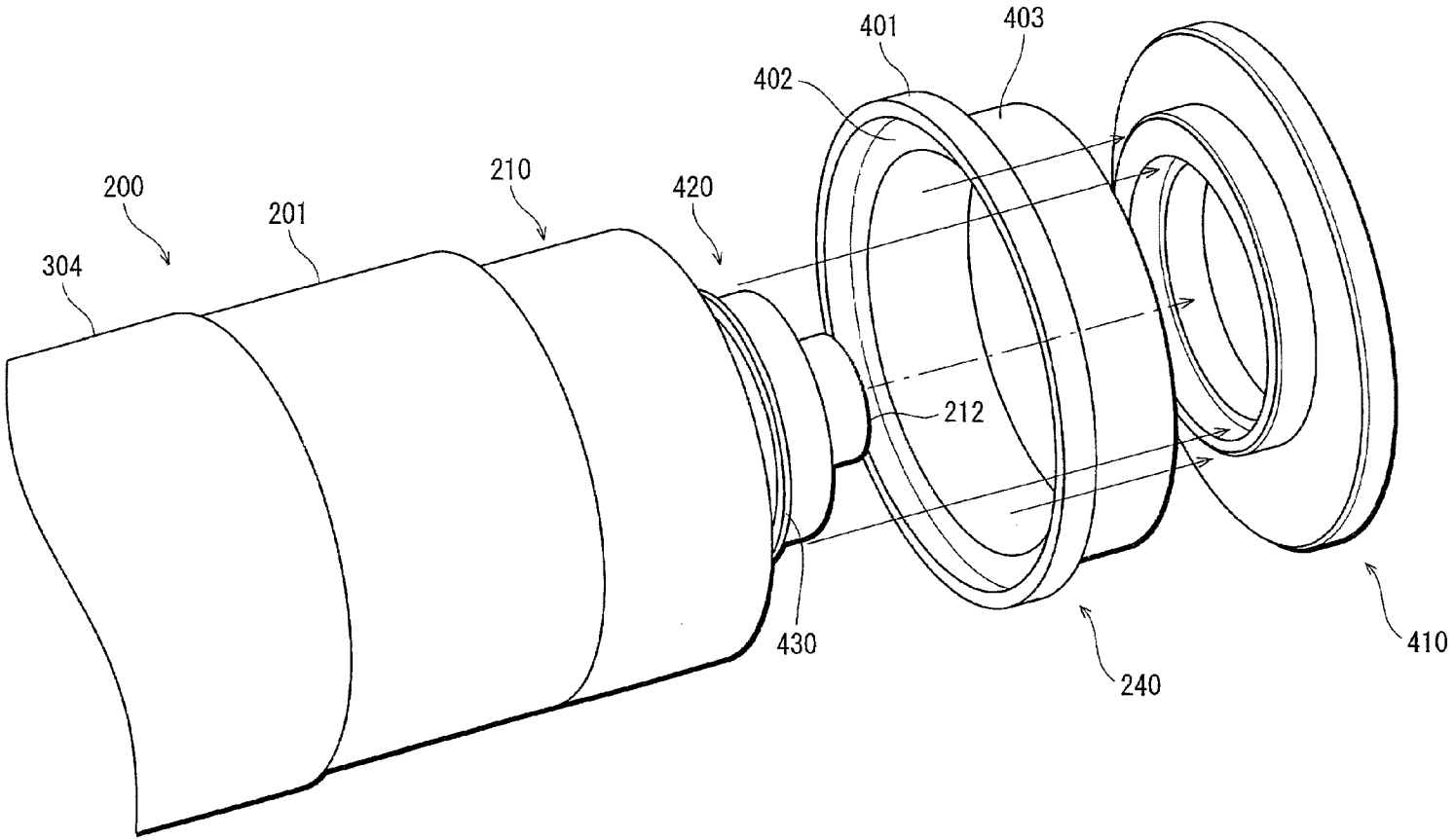
FIG. 4 is an exploded view showing the general form of a meandering prevention member 240.
Figure 5B:
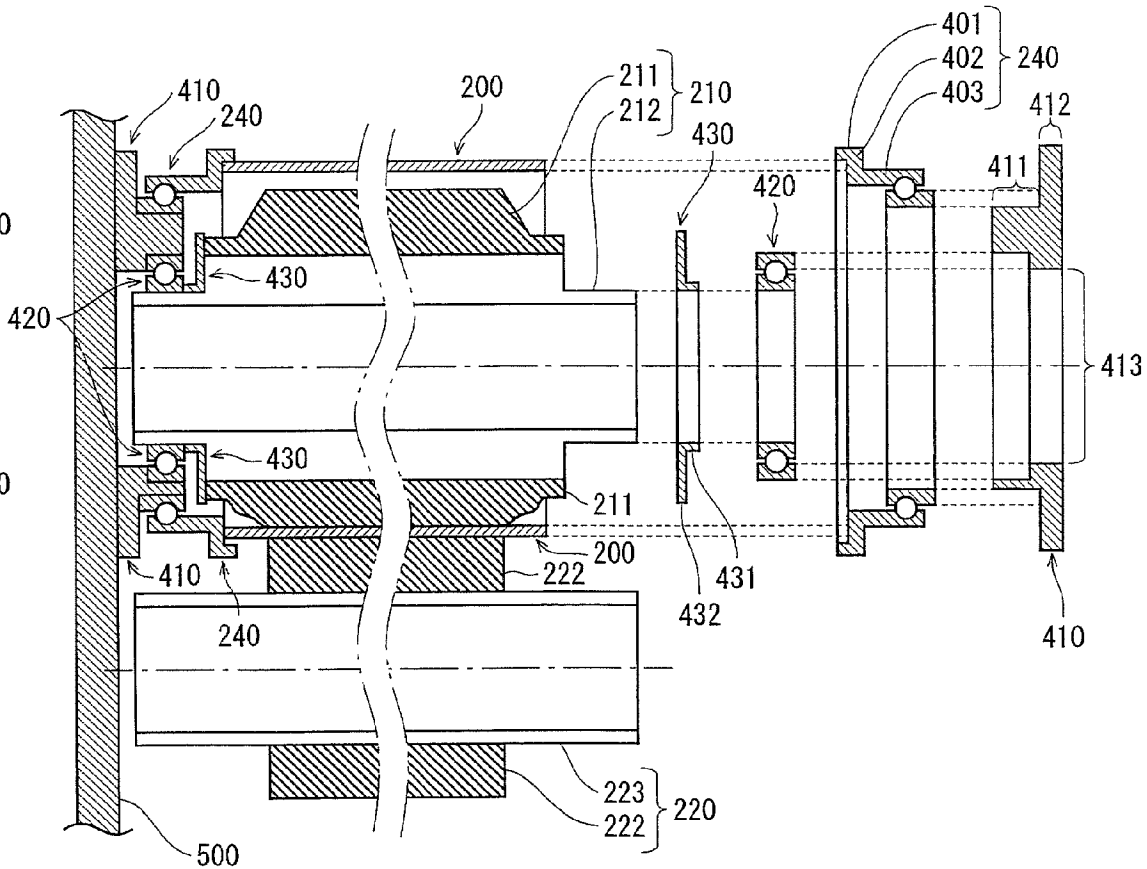
FIG. 5B is a cross-sectional view, taken along a straight line B-B in a pressure direction shown in FIG. 5A.
Figure 5A:
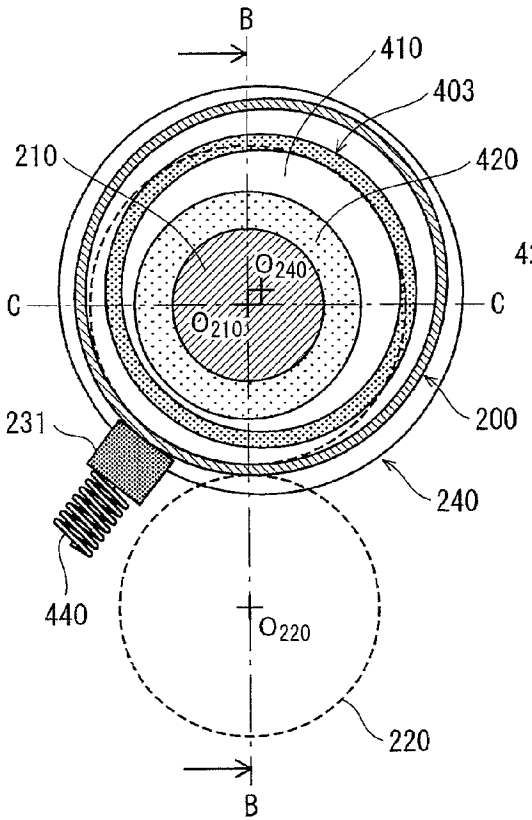
FIG. 5A is a cross-sectional view showing the meandering prevention member 240, in a plane perpendicular to the rotation axis of a fixing roller 210.

FIG. 4 is an exploded view showing the general form of the meandering prevention member 240. FIG. 5A is a cross-sectional view showing the meandering prevention member 240, in a plane perpendicular to the rotation axis of a fixing roller 210, and FIG. 5B is a cross-sectional view showing the meandering prevention member 240, taken along a straight line B-B in a pressure direction shown in FIG. 5A. As described above, the straight line B-B in the pressure direction is a straight line connecting the rotation center $O_{210}$ of the fixing roller 210 and the rotation center $O_{220}$ of the pressure roller 220. The straight line B-B in the pressure direction passes through the center of a fixing nip in the rotational direction (circumferential direction) of the fixing roller 210. Accordingly, the straight line B-B in the pressure direction is also a straight line passing through the rotation center $O_{210}$ of the fixing roller 210 and the center of the fixing nip in the rotational direction of the fixing roller 210.

As shown in FIG. 4, FIG. 5A, and FIG. 5B, the meandering prevention members 240 each have a cylindrical part 401, a bottom part 402, and a bearing 403, and are for example formed from a metal or a heat-resistant resin.

The cylindrical parts 401 come into abutment with the outer circumferential surfaces of the sides of the fixing belt 200 in the width direction of the fixing belt 200 to prevent the fixing belt 200 from becoming displaced in the radius direction of the fixing belt 200. As described above, the belt rotation path on which the fixing belt 200 runs is in the shape of an ellipse, which is formed by the cross section of the fixing belt 200. This brings the fixing belt 200 into abutment with each of the cylindrical parts 401 at a position on the belt rotation path that is most distant from the center of the ellipse. The cylindrical part 401 comes into abutment with the outer circumferential surface of the fixing belt 200 at the position which is most distant from a position where the pressure roller 220 and the power feeding brush 231 come into abutment with the fixing belt 200. An abutment force of the cylindrical part 401 acts on the outer circumferential surface of the fixing belt 200, so as to counteract abutment forces of the pressure roller 220 and the power feeding brush 231. This stabilizes the belt rotation path on which the fixing belt 200 runs, thereby maintaining an excellent contact state between the power feeding brush 231 and the fixing belt 200.

The bottom parts 402 faces the sides of the fixing belt 200 in the width direction of the fixing belt 200, and each have a flat portion perpendicular to the rotation axis of the fixing belt 200. The bottom part 402 prevents the fixing belt 200 from becoming displaced in the rotation axis direction, by bringing the flat portion into abutment with the side of the fixing belt 200. Also, the flat portion comes into sliding contact with the side of the fixing belt 200, and as a result the meandering prevention member 240 is driven to rotate.

The bearings 403 are for example each a ball bearing, and is fit onto a cylindrical holding part 411 of a prevention member holder 410, which is described later. This enables the meandering prevention member 240 to be rotatably held by the prevention member holder 410. As shown in FIG. 5A, the rotation axis of the meandering prevention member 240 is not positioned on the straight line B-B in the pressure direction, and is coincident with the central axis of the outer circumferential surface of the cylindrical holding part 411 though not illustrated in FIG. 5B.

The prevention member holders 410 each have the cylindrical holding part 411 and a plate-like fastening part 412. The holding part 411 has an outer circumferential surface and an inner circumferential surface which are each cylindrical. As described above, the bearing 403 of the meandering prevention member 240 is fit onto the outer circumferential surface of the holding part 411. Also, a bearing 420 is fit into the inner circumferential surface of the holding part 411, and the metal core 212 of the fixing roller 210 is rotatably supported via the bearing 420.

The holding part 411 has the structure in which the central axis of the outer circumferential surface is not coincident with the central axis of the inner circumferential surface. As shown in FIG. 5A, the power feeding brush 231 is forced by a forcing unit 440, and thereby is brought into pressure-contact with the electrode part 201 of the fixing belt 200. Due to components in a direction perpendicular to the straight line B-B in the pressure direction which are contained in this pressure contact force, the fixing belt 200 elastically deforms so as to expand towards the opposite side of the power feeding brush 231 across the straight line B-B in the pressure direction. Also, a straight line C-C shown in FIG. 5A is a straight line that passes through the rotation center $O_{210}$ of the fixing roller 210 and is perpendicular to the straight line B-B in the pressure direction (hereinafter, referred to as perpendicular straight line C-C). Due to components in a direction perpendicular to the perpendicular straight line C-C which are contained in the pressure contact force of the power feeding brush 231, the fixing belt 200 elastically deforms so as to expand towards the opposite side of the power feeding brush 231 across the perpendicular straight line C-C.

In order to minimize the difference in speed between the meandering prevention member 240 and the fixing belt 200 which is deforming in this way during sliding contact with each other, the rotation center $O_{240}$ of the meandering prevention member 240 is also positioned on the opposite side of the power feeding brush 231 across both the straight line B-B in the pressure direction and the perpendicular straight line C-C.

Figure 6A:
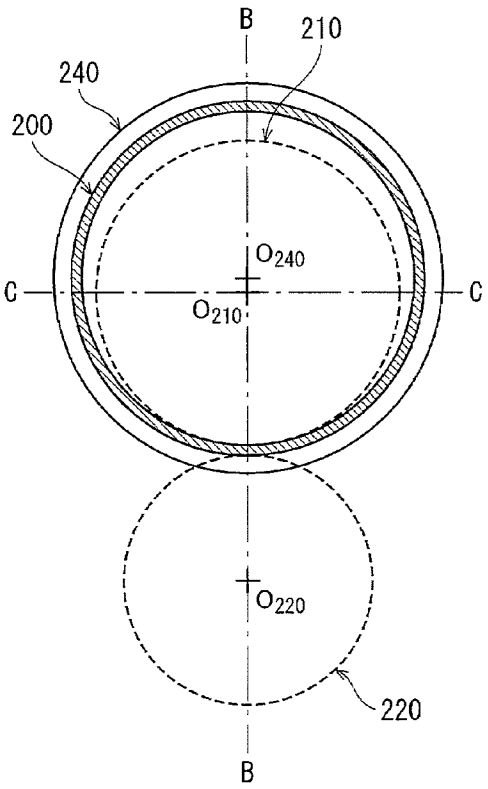
FIG. 6A Prior Art
FIG. 6A is a cross-sectional view showing arrangement relating to a conventional art of the meandering prevention member 240 in a fixing device employing the electromagnetic induction heating system.
Figure 6B:
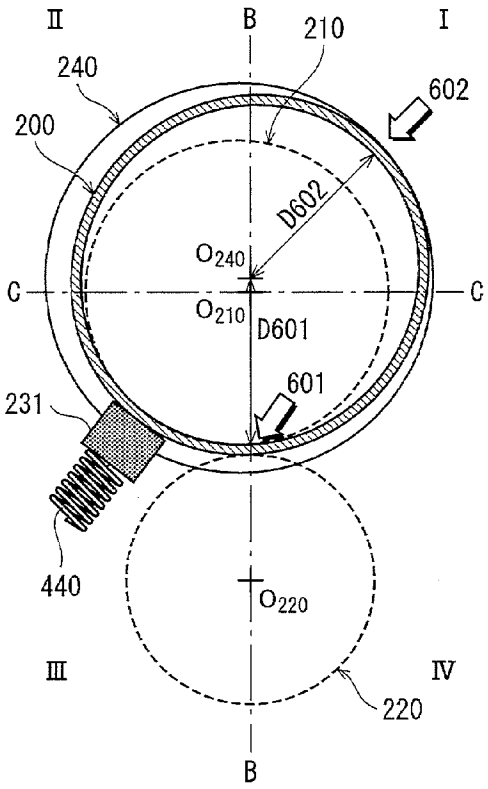
FIG. 6B Prior Art
FIG. 6B is a cross-sectional view showing arrangement relating to a conventional art of the meandering prevention member 240 in a fixing device employing the employing the resistance heating system.
Figure 6C:
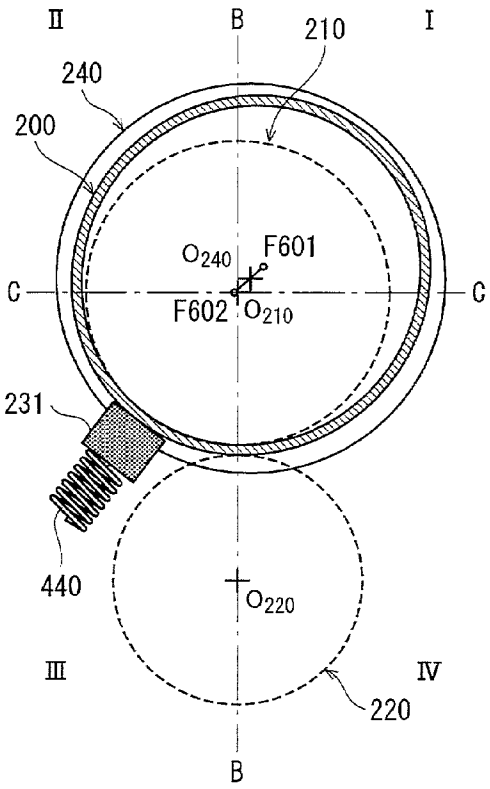
FIG. 6C is a cross-sectional view showing arrangement relating to an embodiment of the present invention of the meandering prevention member 240.

FIG. 6A to FIG. 6C show comparison between the present embodiment and conventional arts in terms of arrangement of the meandering prevention member 240. FIG. 6A is a cross-sectional view showing arrangement relating to a conventional art in a fixing device employing the electromagnetic induction heating system, FIG. 6B is a cross-sectional view showing arrangement relating to a conventional art in a fixing device employing the resistance heating system, and FIG. 6C is a cross-sectional view showing arrangement relating to the present embodiment. FIG. 6A to FIG. 6C each show the cross section of the meandering prevention member 240 that is perpendicular to the rotation axis of the fixing roller 210, and show the same members with the same referential numerals.

As shown in FIG. 6A, the fixing device employing the electromagnetic induction heating system has the structure in which the power feeding brush 231 is not brought into pressure-contact with the fixing belt 200, and accordingly the belt rotation path of the fixing belt 200 is substantially circular. Also, the belt rotation path of the fixing belt 200 has a rotation center on a straight line B-B in the pressure direction that connects the rotation center $O_{210}$ of the fixing roller 210 and the rotation center $O_{220}$ of the pressure roller 220. Therefore, by making the rotation center $O_{240}$ of the meandering prevention member 240 coincident with the rotation center of the belt rotation path of the fixing belt 200, it is possible to ensure a constant distance from a sliding contact position between the fixing belt 200 and the meandering prevention member 240 to the rotation center $O_{240}$ of the meandering prevention member 240. This reduces the difference in peripheral speed between the meandering prevention member 240 and the fixing belt 200.

Next, as shown in FIG. 6B, the fixing device employing the resistance heating system has the structure in which the fixing belt 200 is brought into pressure-contact with the power feeding brush 231, and thereby to expand toward the first quadrant with the rotation center $O_{210}$ of the fixing roller 210 at the origin. As a result, the belt rotation path is substantially elliptical. A pressure contact position between the power feeding brush 231 and the fixing belt 200 is positioned on the third quadrant. Accordingly, in the case where the meandering prevention member 240 which is the same as that shown in FIG. 6A is adopted, a distance D601 and a distance D602 differ from each other. The distance D601 is a distance from the rotation center $O_{240}$ of the meandering prevention member 240 to a sliding contact position 601 at the fixing nip formed between the fixing belt 200 and the meandering prevention member 240. The distance D602 is a distance from the rotation center $O_{240}$ to a sliding contact position 602 which is the most distant sliding contact position. Therefore, the meandering prevention member 240 has a different peripheral speed between at the sliding contact positions 601 and 602.

On the other hand, the fixing belt 200 has a uniform peripheral speed along the belt rotation path, irrespective of the sliding contact positions 601 and 602. This inevitably causes a difference in peripheral speed between the fixing belt 200 and the meandering prevention member 240. In the case where the meandering prevention member 240 is driven to rotate by a force of friction with the fixing belt 200, the fixing belt 200 is higher in peripheral speed than the meandering prevention member 240 at a sliding contact position that is more distant from the rotation center $O_{240}$ of the meandering prevention member 240. Conversely, the fixing belt 200 is lower in peripheral speed than the meandering prevention member 240 at a sliding contact position that is closer to the rotation center $O_{240}$ of the meandering prevention member 240. As a result, the fixing belt 200 cannot be brought into sliding contact with the meandering prevention member 240. For this reason, if the meandering prevention member 240 relating to the conventional art is adopted to the fixing device employing the resistance heating system, the fixing belt 200 might be abraded away, damaged, or the like due to sliding contact with the meandering prevention member 240.

Compared with this, according to the present embodiment as shown in FIG. 6C, in the case where a pressure contact position between the power feeding brush 231 and the fixing belt 200 is positioned on the third quadrant like in FIG. 6A and FIG. 6B, the rotation center $O_{240}$ of the meandering prevention member 240 is positioned on the first quadrant with the rotation center $O_{210}$ of the fixing roller 210 at the origin, in accordance with expansion of the fixing belt 200. Specifically, the rotation center $O_{240}$ of the meandering prevention member 240 is positioned on the midpoint between two focal points F601 and F602 on the substantially elliptical belt rotation path of the fixing belt 200.

By positioning the rotation center $O_{240}$ of the meandering prevention member 240 on such a position, it is possible to minimize the difference between the maximum distance and the minimum distance from the rotation center $O_{240}$ to the belt rotation path of the fixing belt 200. The peripheral speed of the meandering prevention member 240 is proportional to the distance from the rotation center $O_{240}$ to the belt rotation path. Accordingly, by minimizing the distance variation range from the rotation center $O_{240}$ to the belt rotation path, it is possible to minimize the difference in peripheral speed. This prevents the fixing belt 200 from being abraded away, damaged, or the like due to sliding contact with the meandering prevention member 240.

Also, as another conventional art, there has proposed the structure in which the circumferential length of the fixing belt 200 is increased and the fixing belt 200 stretches and lays on the plurality of fixing rollers 210. It is true that, even with this conventional art, meandering of the fixing belt 200 can be prevented by providing the meandering prevention member 240 for each of the fixing rollers 210. However, it is difficult to rotatably support each of the meandering prevention members 240 due to too complicated apparatus structure.

For this reason, in the conventional structure in which the number of the fixing rollers 210 is plural, there is a difficulty in solving the problem caused by sliding contact between the fixing belt 200 and the meandering prevention member 240. According to the present embodiment compared with this, it is possible to solve the problem caused by sliding contact between the fixing belt 200 and the meandering prevention member 240, by minimizing the difference in peripheral speed between the fixing belt 200 and the meandering prevention member 240 with the structure which is not too complicated for supporting the fixing belt 200 and preventing meandering of the fixing belt 200.

Now returning to FIG. 5B, the fastening part 412 has a through-hole 413 provided therein, and the side of the metal core 212 enters the through-hole 413. The prevention member holder 410 is fastened on and held by a housing 500 of the fixing device 100, by fastening the fastening part 412 with a screw for example.

The bearing 420 is fit into the holding part 411 of the prevention member holder 410, and bears the metal core 212 of the fixing roller 210 such that the metal core 212 is rotatable relative to the prevention member holder 410, as described above. The bearing 420 comes into abutment with a roller elastic layer prevention member 430 at a surface of the bearing 420 which is closer to the fixing belt 200.

The roller elastic layer prevention member 430 is a ring-shaped member, and has a boss part 431 and a flange part 432 at each side thereof. The roller elastic layer prevention member 430 is fit onto the respective ends of the metal core 121 of the fixing roller 210, so as to bring the flange parts into abutment with the respective end surfaces of the elastic layer 211 of the fixing roller 210. When the elastic layer 211 of the fixing roller 210 is compressed by a pressing force of the pressure roller 220 at the fixing nip, the elastic layer 211 generates a force pushing towards each side of the metal core 121 by an elastic restoring force thereof to expand towards each end of the metal core 121.

Here, the elastic layer 211 (the fixing roller 210) is rotatable relative to the meandering prevention member 240 and the prevention member holder 410. Accordingly, when the elastic layer 211 abuts with the meandering prevention member 240 and/or the prevention member holder 410, the elastic layer 211 is brought into sliding contact with the meandering prevention member 240 and/or the prevention member holder 410. This might cause damage of the elastic layer 211 such as shaving of the elastic layer 211, and as a result the lifetime of the elastic layer 211 might be reduced. Furthermore, if the force pushing towards each side of the metal core 121 continues to act on an adhesive layer provided between the elastic layer 211 and the metal core 212, the elastic layer 211 might peel off from the metal core 212.

Compared with this, by bringing the flange part 432 of the roller elastic layer prevention member 430, which rotates together with the fixing roller 210, into abutment with the elastic layer 211, it is possible to prevent sliding contact of the elastic layer 211 with the meandering prevention member 240 and/or the prevention member holder 410. Also, it is possible to prevent the elastic layer 211 from becoming displaced towards each side of the metal core 121, thereby preventing the elastic layer 211 from peeling off from the metal core 212.

According to the present invention, it is possible to reduce sliding contact between the fixing belt 200 and the meandering prevention member 240, thereby generating no abrasion powders resulting from abrasion of the fixing belt 200. This causes no dust and dirt of abrasion powders in the fixing device 100 and in recording sheets, thereby realizing image formation with a high quality. Furthermore, there occurs no secondary problem due to abrasion powders.

[4] Modification Examples

Although the present invention has been described based on the above embodiment, the present invention is of course not limited to the above embodiment, and the following modification examples may be employed.

(1) In the above embodiment, the description has been given on the case where the meandering prevention member 240 is rotatably supported by the prevention member holder 410, which has the cylindrical holding part 411 whose inner circumferential surface and outer circumferential surface each have a different central axis, and this reduces sliding contact between the fixing belt 200 and the meandering prevention member 240. However, the present invention is of course not limited to this structure, and the meandering prevention member 240 may be supported in the following manner instead.

Figure 7B:
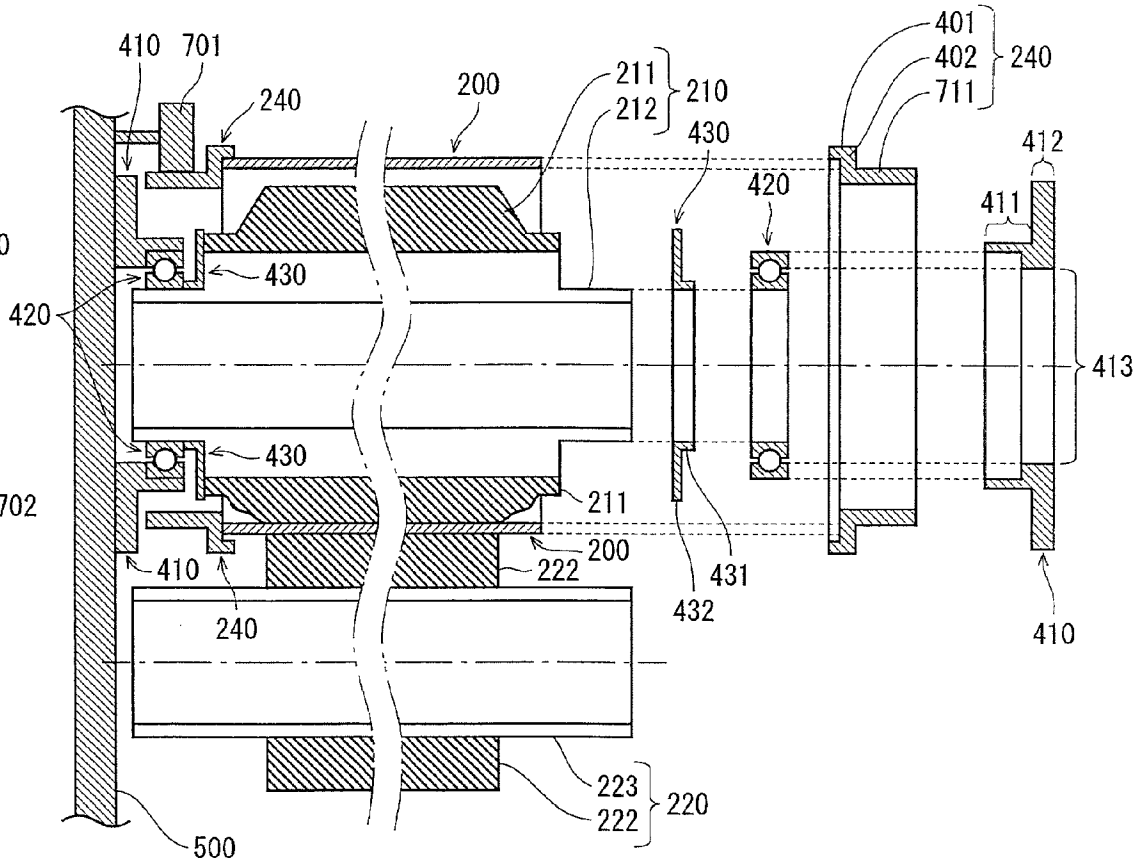
FIG. 7B is a cross-sectional view, taken along a straight line B-B in a pressure direction shown in FIG. 7A.
Figure 7A:
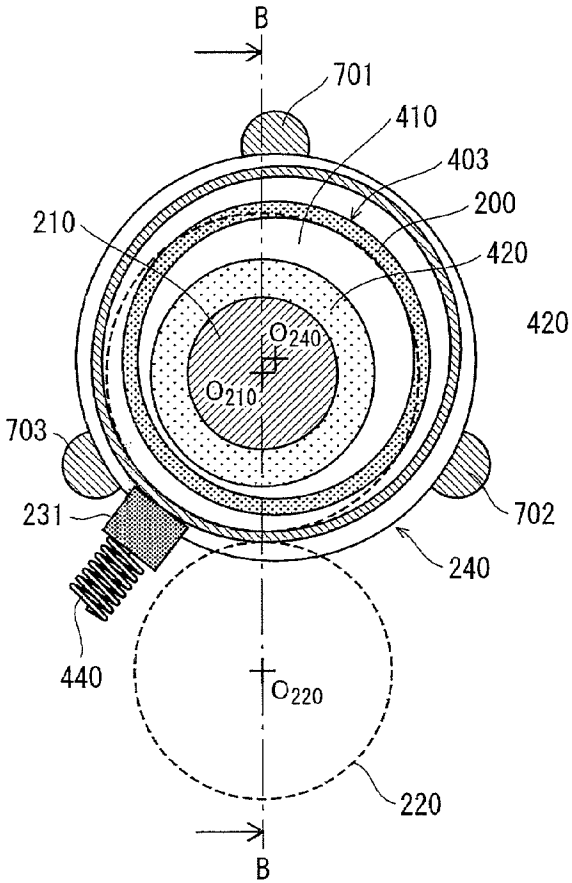
FIG. 7A is a cross-sectional view showing the structure of main elements of a fixing device relating to a modification example of the present invention, in a plane perpendicular to the rotation axis of a fixing roller 210.

FIG. 7A and FIG. 7B each show the structure of main elements of a fixing device relating to the present modification example. FIG. 7A is a cross-sectional view showing the fixing device, in a plane perpendicular to the rotation axis of a fixing roller 210. FIG. 7B is a cross-sectional view showing the fixing device, taken along a straight line B-B in a pressure direction shown in FIG. 7A. Note that the same members in FIG. 7A and FIG. 7B as those shown in FIG. 5A and FIG. 5B have the same referential numerals. As shown in FIG. 7A and FIG. 7B, while the fixing device relating to the present modification example has substantially the same structure as the fixing device relating to the above embodiment, the structure for supporting the meandering prevention member 240 differs therebetween.

Specifically, the meandering prevention member 240 relating to the present modification example has a cylindrical part 401 and a bottom part 402 like the meandering prevention member 240 relating to the above embodiment. On the other hand, the meandering prevention member 240 relating to the present modification example includes a supported part 711 instead of the bearing 403 included in the meandering prevention member 240 relating to the above embodiment. In the supported part 711, the meandering prevention member 240 is rotatably supported by three rollers 701 to 703.

The rollers 701 to 703 are provided on the outer circumference of the meandering prevention member 240 at an interval of 120 degrees around the rotation axis of the meandering prevention member 240. The rollers 701 to 703 are each supported so as to be rotatable relative to a housing 500. The rotation axis of the meandering prevention member 240 relating to the present modification example is positioned on the same position as that of the rotation axis of the meandering prevention member 240 relating to the above embodiment.

Also, a prevention member holder 410 relating to the present modification example rotatably supports the metal core 212 of the fixing roller 210 via the bearing 420, like the prevention member holder 410 relating to the above embodiment. However, in the present modification example, the prevention member holder 410 is out of contact with the meandering prevention member 240 because the meandering prevention member 240 does not include the nearing 402 relating to the above embodiment.

Even in the case where the meandering prevention member 240 is supported in this way, it is possible to minimize the difference in peripheral speed between the fixing belt 200 and the meandering prevention member 240 at the sliding contact position between the side of the fixing belt 200 and the meandering prevention member 240. This prevents the fixing belt 200 from being abraded away, damaged, and so on.

(2) In the above embodiment, the description has been given on the case where, when seen in the rotation axis direction of the fixing roller 210, the rotation center $O_{240}$ of the meandering prevention member 240 is positioned on the midpoint between two focal points of the elliptical belt rotation path of the fixing belt 200. However, the present invention is of course not limited to this structure. Alternatively, by providing the meandering prevention member 240 such that the rotation center $O_{240}$ is positioned on a line segment connecting the two focal points, it is possible to reduce the difference in peripheral speed between the fixing belt 200 and the meandering prevention member 240, thereby preventing abrasion and so on of the fixing belt 200.

Furthermore, it is also possible to exhibit a certain level of effects by providing the meandering prevention member 240 as follows. Specifically, the rotation center $O_{240}$ of the meandering prevention member 240 is positioned inside the belt rotation path of the fixing belt 200, and is positioned on the opposite side of the power feeding brush 231 across both the straight line B-B in the pressure direction, which passes through the rotation center $O_{210}$ of the fixing roller 210 and the rotation center $O_{220}$ of the pressure roller 220, and the perpendicular straight line C-C, which passes through the rotation center $O_{210}$ of the fixing roller 210 and is perpendicular to the straight line B-B in the pressure direction.

(3) In the above embodiment, the description has been given on the case where, when seen in the rotation axis direction of the fixing roller 210, the rotation center $O_{240}$ of the meandering prevention member 240 is positioned on the midpoint between two focal points of the elliptical belt rotation path of the fixing belt 200. However, the present invention is of course not limited to this structure. Alternatively, in the case where the belt rotation path of the fixing belt 200 is not an ellipse, the meandering prevention member 240 may be provided such that the rotation center $O_{240}$ is positioned on the midpoint between two focal points of an ellipse approximating the belt rotation path. Here, the ellipse approximating the belt rotation path indicates an ellipse that is included in a circle circumscribed with the belt rotation path and includes therein a circle inscribed with the belt rotation path. Even with this structure, it is possible to reduce abrasion and so on of the fixing belt 200, thereby preventing reduction in lifetime of the fixing belt 200.

(4) In the above embodiment, the description has been given on the case where the meandering prevention member 240 is provided such that the rotation center $O_{240}$ of the meandering prevention member 240 is positioned on the midpoint between two focal points of the elliptical belt rotation path of the fixing belt 200. However, the present invention is of course not limited to this structure. Alternatively, the rotation center $O_{240}$ of the meandering prevention member 240 may be positioned with no assumption of such an ellipse.

The rotation center $O_{240}$ of the meandering prevention member 240 may be positioned, such that, in consideration of that the peripheral speed of the meandering prevention member 240 is proportional to the distance from the rotation center $O_{240}$ to the fixing belt 200, the smallest difference is obtained between the maximum distance and the minimum distance from the rotation center $O_{240}$ to the belt rotation path of the fixing belt 200. Hereinafter, the difference between the maximum distance and the minimum distance from the rotation center $O_{240}$ to the belt rotation path of the fixing belt 200 is referred to as distance variation range. The peripheral speed of the fixing belt 200 at the sliding contact position is constant. Accordingly, by positioning the rotation center $O_{240}$ such that the distance variation range is smallest, it is possible to minimize the difference in peripheral speed between the meandering prevention member 240 and the fixing belt 200 at the sliding contact position.

Figure 8B:
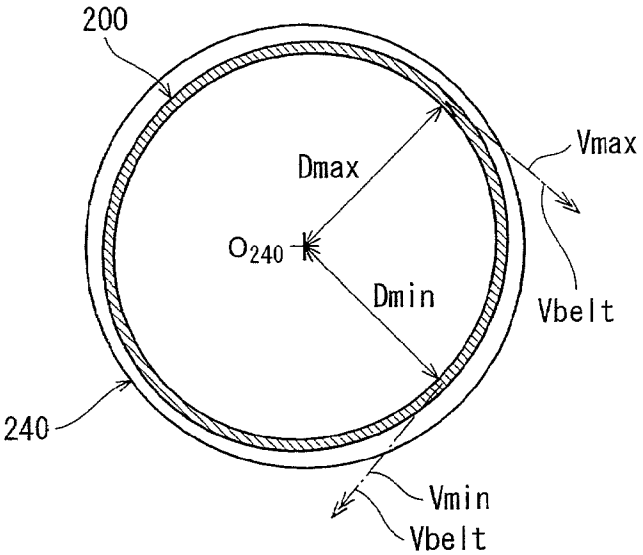
FIG. 8B exemplifies a small variation range of the distance from the rotation center $O_{240}$ of the meandering prevention member 230 to the fixing belt 200.
Figure 8A:
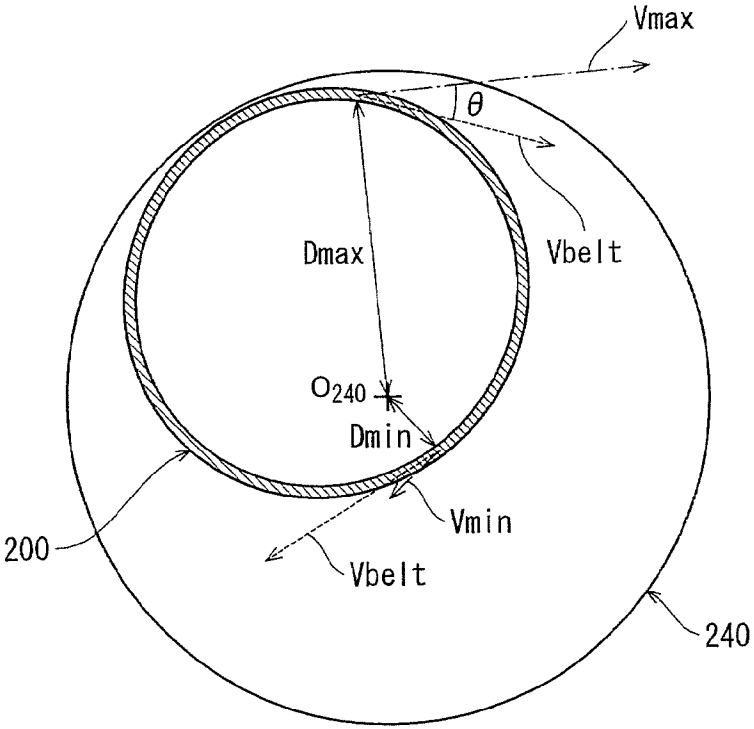
FIG. 8A exemplifies a large variation range of a distance from the rotation center $O_{240}$ of the meandering prevention member 230 to the fixing belt 200.

FIG. 8A and FIG. 8B each exemplify a distance from the rotation center $O_{240}$ to the fixing belt 200. As shown in FIG. 8A, in the case where the distance variation range, which is the difference between the maximum distance Dmax and the minimum distance Dmin, is large, the maximum peripheral speed Vmax of the meandering prevention member 240 at the sliding contact position relating to the maximum distance Dmax is greatly higher than the peripheral speed Vbelt of the fixing belt 200. Also, the maximum peripheral speed Vmin of the meandering prevention member 240 at the sliding contact position relating to the minimum distance Dmin is greatly lower than the peripheral speed Vbelt of the fixing belt 200.

Furthermore, in FIG. 8A, there is observed a large difference in the tangential direction (angle θ) between the fixing belt 200 and the meandering prevention member 240 at the sliding contact position relating to the maximum distance Dmax. In other words, the meandering prevention member 240 and the fixing belt 200 are brought into sliding contact with each other, also due to the difference in direction of peripheral speed. Therefore, in the case where the distance variation range between the maximum distance Dmax and the minimum distance Dmin is large, the fixing belt 200 is easily abraded away for example due to sliding contact with the meandering prevention member 240.

Compared with this as shown in FIG. 8B, in the case where the distance variation range is small, there is observed a small difference between the maximum peripheral speed Vmax of the meandering prevention member 240 at the sliding contact position relating to the maximum distance Dmax and the minimum peripheral speed Vmin of the meandering prevention member 240 at the sliding contact position relating to the minimum distance Dmin. In the case where the meandering prevention member 240 is driven by the fixing belt 200 to rotate, the maximum peripheral speed Vmax is higher than the peripheral speed Vbelt of the fixing belt 200, and the minimum peripheral speed Vmin is lower than the peripheral speed Vbelt of the fixing belt 200. As a result, there is observed a small difference in peripheral speed between the meandering prevention member 240 and the fixing belt 200. Therefore, minimization of the distance variation range reduces abrasion and so on of the fixing belt 200, thereby increasing the lifetime of the fixing belt 200.

In the case where the belt rotation path of the fixing belt 200 is in the shape of an ellipse, the distance variation range is smallest when the rotation center $O_{240}$ is positioned on the intersection point between the major axis and the minor axis of the ellipse. This intersection point is coincident with the midpoint between the two focal points of the ellipse.

Also, the distance D from the rotation center $O_{240}$ to the meandering prevention member 240 and the fixing belt 200 is integrated along the entire circumference of the fixing belt 200. This results in an index value of the average (hereinafter, average index) M of the peripheral speed of the meandering prevention member 240 at the sliding contact position with the fixing belt 200. Then, a value $(D-M)^2$, which results from squaring a difference of the average index M from the distance D from the rotation center $O_{240}$ of the meandering prevention member 240 to the fixing belt 200, is integrated along the entire circumference of the fixing belt 200. This results in an index value of a variance value (hereinafter, variance index) S of the peripheral speed of the meandering prevention member 240 at the sliding contact position with the fixing belt 200. Accordingly, by positioning the rotation center $O_{240}$ such that the variance index S is smallest, it is possible to further exactly minimize the distance variation range at the sliding contact position.

Figure 9:
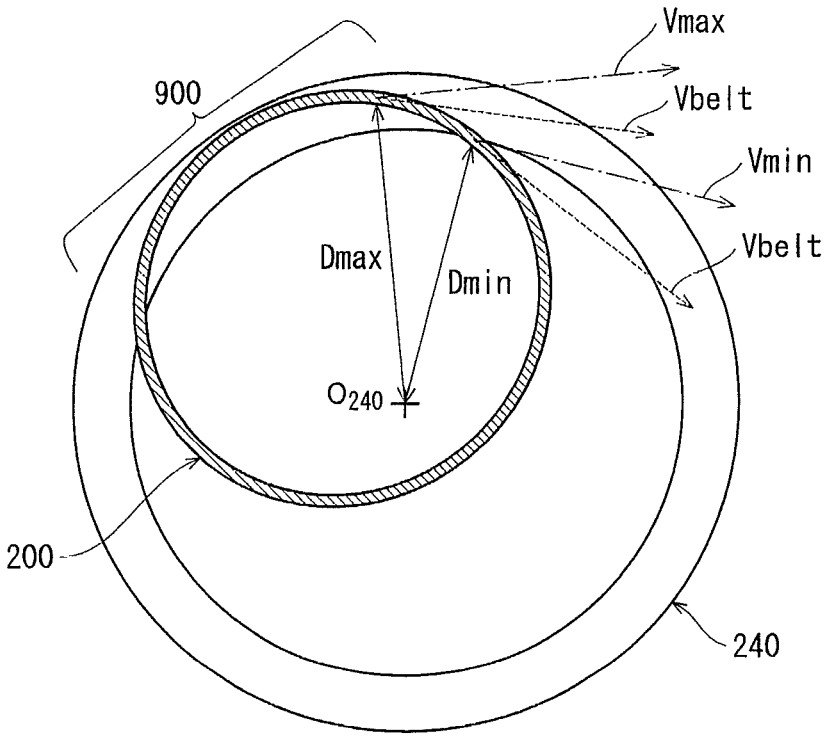
FIG. 9 exemplifies a range of sliding contact between the meandering prevention member 240 and the fixing belt 200 in the case where a surface of the meandering prevention member 240 is in abutment with the fixing belt 200 is circular.

Furthermore, in the case where the meandering prevention member 240 is out of contact with part of the circumference of the fixing belt 200, the rotation center $O_{240}$ of the meandering prevention member 240 is desirably positioned such that the average index M and the distance variation range are minimized without taking into consideration the part of the fixing belt 200 that is out of contact with the meandering prevention member 240. FIG. 9 exemplifies a range of sliding contact between the meandering prevention member 240 and the fixing belt 200 in the case where a surface of the meandering prevention member 240 that is in abutment with the fixing belt 200 is circular. Note that the position of the rotation center $O_{240}$ of the meandering prevention member 240 in FIG. 9 is the same as that in FIG. 8A.

FIG. 9 shows that only part of the circular surface (abutment range 900) of the meandering prevention member 240 is brought into sliding contact with the fixing belt 200. In this case, only with respect the abutment range 900, the rotation center $O_{240}$ should be positioned such that the distance variation range from the rotation center $O_{240}$ to the fixing belt 200 is smallest. This is because it is unnecessary to take into consideration a range where the meandering prevention member 240 is out of abutment with the fixing belt 200.

Note that, without positioning the rotation center $O_{240}$ of the meandering prevention member 240 on the optimal position as described above, the meandering prevention member 240 may be provided such that the rotation center $O_{240}$ is positioned within a range distant from the optimal position by a predetermined distance. This reduces the difference in peripheral speed between the meandering prevention member 240 and the fixing belt 200 at the sliding contact position, compared with a conventional art.

Figure 10:
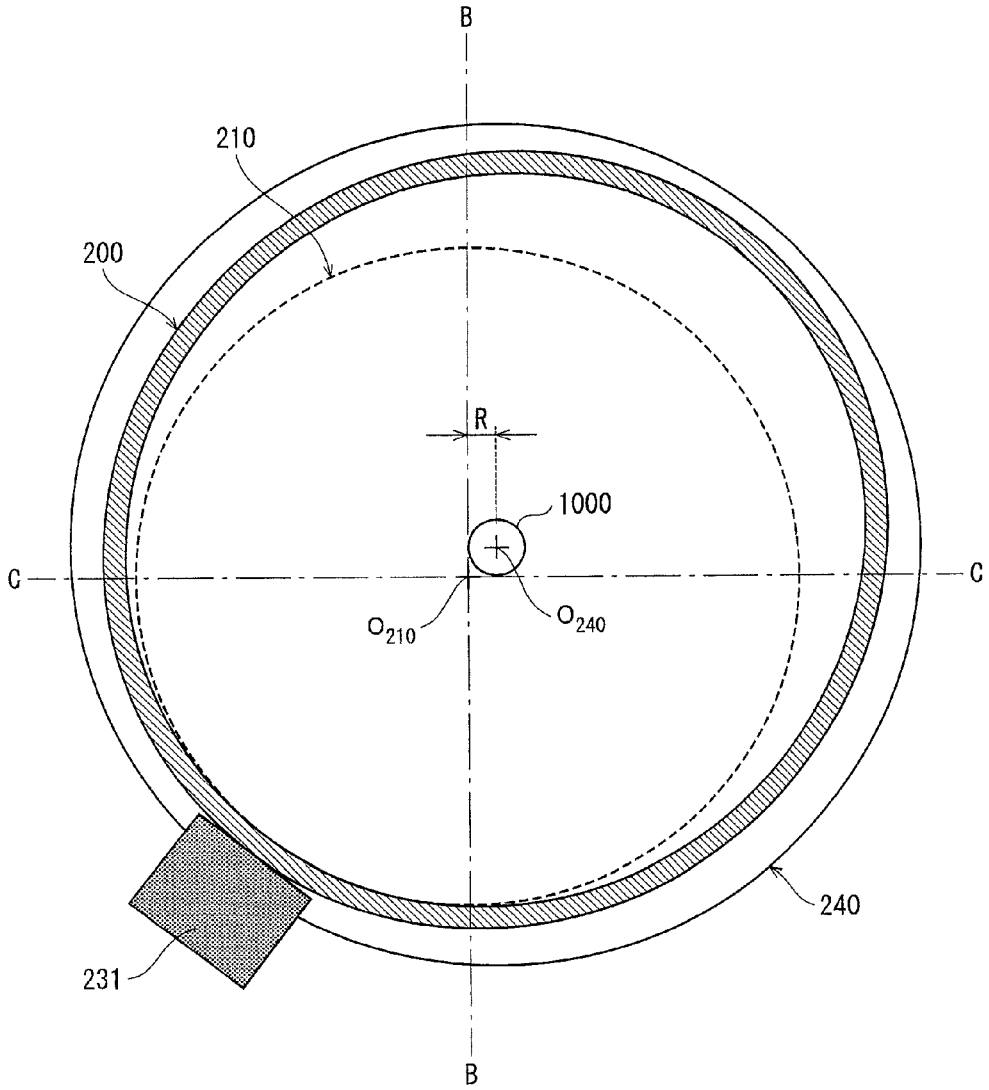
FIG. 10 is a cross-sectional view showing the center of the meandering prevention member within a defined circle.

FIG. 10 is a cross-sectional view showing a range where the rotation center $O_{240}$ is positioned at a degree that the difference in peripheral speed is reduced compared with a conventional art. As shown in FIG. 10, the meandering prevention member 240 is provided, such that the rotation center $O_{240}$ of the meandering prevention member 240 is positioned within a circle 1000, where the circle 1000 centers on the rotation center $O_{240}$ positioned on the optimal position and has a radius equal to a distance from the rotation center $O_{240}$ to the straight line B-B in the pressure direction. This reduces the difference in peripheral speed between the meandering prevention member 240 and the fixing belt 200, thereby easing the sliding contact force, compared with the conventional art in which the rotation center $O_{240}$ is positioned on the straight line B-B in the pressure direction. Note that the inside of a circle indicates a region of the entire circle excepting the circumference of the circle, in other words, a region of a concentric circle having a radius that is smaller than the radius R of the circle.

(5) In the above embodiment, the description has been given on the case where the meandering prevention members 240 are brought into sliding contact with the sides of the fixing belt 200 so as to be driven by the fixing belt 200 to rotate. However, the present invention is of course not limited to this structure. Alternatively, the following structure may be employed instead.

Figure 11:
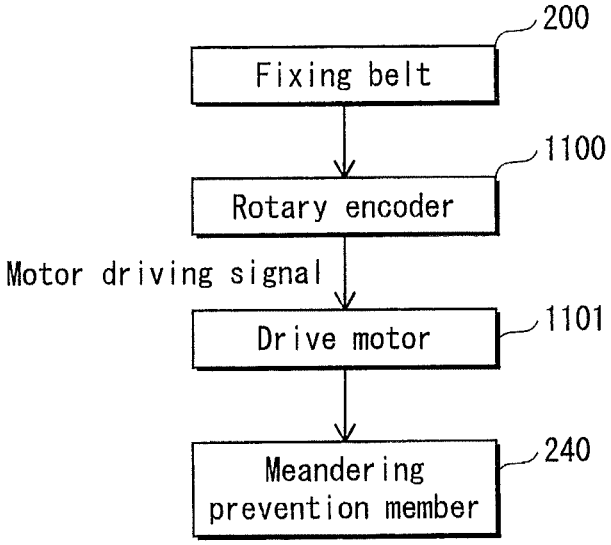
FIG. 11 is a block diagram showing a necessary structure for driving the meandering prevention member 240 to rotate.

The meandering prevention members 240 each may be driven to rotate in accordance with rotation of the fixing belt 200. FIG. 11 is a block diagram showing a necessary structure for driving the meandering prevention member 240 to rotate. As shown in FIG. 11, a mark for detecting the rotational speed of the fixing belt 200 is attached on the outer circumferential surface of the fixing belt 200. A rotary encoder 1100 includes an LED (Light Emitting Diode) that irradiates with detection light the mark attached on the outer circumferential surface of the fixing belt 200 and an optical sensor that detects light reflected off the mark. The rotary encoder 1100 measures the number of flickering of the reflected light in a predetermined period.

It is judged that as the number of flickering of the reflected light is more, the rotational speed of the fixing belt 200 is higher, and the number of flickering of the reflected light is less, the rotational speed of the fixing belt 200 is lower. Accordingly, the rotary encoder 1100 outputs a motor driving signal in accordance with the number of flickering of the reflected light. The drive motor 1101 drives the meandering prevention members 240 to rotate at a rotational speed in accordance with the motor driving signal output from the rotary encoder 1100. With this structure, in the case where the bearing or the like of the meandering prevention member 240 deteriorates over time due to abrasion, and this might hinder the meandering prevention member 240 from smoothly rotating by friction with the fixing belt 200, it is possible to forcefully drive the meandering prevention member 240 to rotate, thereby reducing abrasion and so on of the fixing belt 200 due to sliding contact.

In this situation, in the case where the difference in peripheral speed varies depending on the sliding contact position between the fixing belt 200 and the meandering prevention member 240, a motor driving signal to be output from the rotary encoder 1100 may be adjusted such that the difference in peripheral speed is smallest.

Note that the drive motor 1101 may also function as a drive source of the pressure roller 220. In this case, the drive motor 1101 may adjust the rotational speed of the pressure roller 220, instead of adjusting the rotational speed of the meandering prevention member 240. In other words, the drive motor 1101 may drive the meandering prevention member 240 to rotate at a constant rotational speed, and adjust the rotational speed of the pressure roller 220 such that the fixing belt 200 rotates at a rotational speed in accordance with the constant rotational speed of the meandering prevention member 240. Even with this structure, the same effects as those described above can be exhibited.

Further alternatively, the drive motor 1101 may drive the fixing roller 210 to rotate in accordance with rotation of the pressure roller 220. With this structure, it is stabilize the conveyance speed of the fixing belt 200 to convey recording sheets. This prevents distortion of an image due to variation in conveyance speed caused by an uneven coverage rate.

(6) In the above embodiment, the description has been given on the case where a recording sheet is fed through a fixing nip, which is formed by bringing the pressure roller 220 into pressure-contact with the fixing roller 210, and then a toner image is fixed onto the recording sheet. However, the present invention is of course not limited to this structure. Even with use of a stationary pressure member instead of the pressure roller 220, the same effects can be exhibited.

Specifically, assume that the straight line B-B in the pressure direction shown in FIG. 10 passes through the center of a fixing nip formed between the fixing roller 210 and a stationary pressure member in the rotational direction of the fixing roller 210, and also passes through the center $O_{210}$ of the fixing roller 210. In this case, the prevention member holder 410 holds the meandering prevention member 240, such that, when seen in the rotation axis direction of the fixing roller 210, the rotation center $O_{240}$ of the meandering prevention member 240 is positioned within a circle 1000, where the circle 1000 centers on the midpoint between two focal points of an ellipse approximating the belt rotation path of the fixing belt 200, and has a radius equal to a distance from the rotation center $O_{240}$ to the straight line B-B in the pressure direction, which passes through the rotation center $O_{210}$ of the fixing roller 210 and the center of the fixing nip in the rotational direction of the fixing roller 210. This reduces abrasion and so on of the fixing belt 200, thereby preventing reduction in lifetime of the fixing belt 200.

(7) In the above embodiment, the description has been given on the case where the meandering prevention member 240 has the cylindrical part 401. However, the present invention is of course not limited to this structure. Alternatively, when taking into consideration only the aim to prevent meandering of the fixing belt 200, the meandering prevention member 240 may include only the bottom part 402 and the bearing 403 without including the cylindrical part 401.

(8) In the above embodiment, the description has been given on the case where one power feeding brush 231 is brought into abutment with each side of the fixing belt 200 in the width direction of the fixing belt 200 to feed electrical power to the faxing belt 200. However, the present invention is of course not limited to this structure. Alternatively, a plurality of power feeding brushes 231 may be caused to abut with each end of the fixing belt 200 to feed electrical power. With this structure, all the power feeding brushes 231 are unlikely to separate from the electrode part 201 at the same time, and any of the power feeding brushes 231 always continues to be in abutment with the electrode part 201. This prevents occurrence of spark discharge to improve the durability of the fixing belt 200, thereby increasing the lifetime of the fixing belt 200.

(9) In the above embodiment, the description has been given on the case where the present invention is applied to a color printing apparatus employing the intermediate transfer system. However, the present invention is of course not limited to this. Alternatively, the present invention may be applied to a color printing apparatus employing a system other than the intermediate transfer system, or a monochrome printing apparatus. Further alternatively, the present invention may be applied to a copy apparatus including a document scanning apparatus, or a facsimile apparatus having a communication function. Yet alternatively, the present invention may be applied to an MFP (Multi Function Peripheral) having functions of these above apparatuses. It is possible to exhibit the effects of the present invention by applying the present invention to an image forming apparatus, irrespective of the type of image forming apparatus to which the present invention is applied.

[5] Summary of Effects

As described above, the fixing device relating to the present invention includes: an endless fixing belt that includes a resistance heating layer that generates Joule heat when electric power is fed thereto and a pair of electrode parts that feed electric power to the resistance heating layer; a pair of power feeding members that are each in abutment with an outer circumferential surface of a corresponding one of the electrode parts to feed electric power to the resistance heating layer through the electrode part; a fixing roller that is loosely inserted into the fixing belt; a pressure member that is in pressure-contact with an outer circumferential surface of the fixing belt to form a fixing nip; a pair of meandering prevention members that are each provided facing a corresponding one of sides of the fixing belt in a width direction of the fixing belt, and prevent the fixing belt from meandering in the width direction; and a pair of prevention member holders that each hold a corresponding one of the meandering prevention members, such that the meandering prevention member rotates independently from the fixing roller, wherein the meandering prevention members are each held so as to have a rotation center positioned inside a circle, where, when seen in a rotation axis direction of the fixing roller, the circle has a center coincident with a midpoint between two focal points of an ellipse approximating a belt rotation path of the fixing belt, and has a radius equal to a distance from the center of the circle to a straight line passing through a rotation center of the fixing roller and a center of the fixing nip in a rotational direction of the fixing roller.

According to the fixing device employing the resistance heating system with the above structure, the power feeding members are in abutment. As a result, when seen in the rotation axis direction of the fixing roller, the midpoint between the two focal points of the ellipse approximating the belt rotation path of the fixing belt, namely, the intersection point between the major axis and the minor axis of the ellipse, is not positioned on the straight line passing through the rotation center of the fixing roller and the center of the fixing nip in the rotational direction of the fixing roller. However, the rotation center of each of the meandering prevention members is positioned close to the midpoint (intersection point) compared with a conventional art. Accordingly, it is possible to reduce the difference in peripheral speed between the fixing belt and the meandering prevention members at the sliding contact position therebetween compared with the conventional art. Therefore, it is possible to prevent the fixing belt from being abraded away, shaving, and so on due to sliding contact with the meandering prevention members.

In this case, it is most desirable that the meandering prevention members are each held so as to have the rotation center that is coincident with the center of the circle. Also, when seen in the rotation axis direction of the fixing roller, the ellipse approximating the belt rotation path of the fixing belt is included in a circle circumscribed with the belt rotation path, and includes therein a circle inscribed with the belt rotation path.

Also, the meandering prevention members each may be held, such that, in a diameter direction thereof in a plane perpendicular to a rotation axis thereof, the rotation axis is positioned equally distant from the nip and from an outermost circumference thereof that is in abutment with the fixing belt.

Also, the fixing device may further include a housing that houses therein the fixing belt, the power feeding members, the fixing roller, the pressure member, the meandering prevention members, and the prevention member holders, wherein the prevention member holders may be fastened to an inner wall of the housing, and the prevention member holders may rotatably hold the fixing roller via a bearing, and each may rotatably hold the corresponding meandering prevention member via a bearing. With this structure, it is possible to reduce the size of the necessary structure for holding the meandering prevention members, thereby realizing the size reduction of the fixing device.

Also, the meandering prevention members each may have an outer circular circumference, and the prevention member holders each may hold the corresponding meandering prevention member by bringing three or more rollers into abutment with the outer circular circumference of the meandering prevention member. In recent years, the size of the fixing device has been increasingly reduced. In the case where it is difficult to use meandering prevention members having a complicated structure, it is effective to use rollers.

Also, by bringing the meandering prevention members into sliding contact with the fixing belt so as to be driven by the fixing belt to rotate, it is possible to reduce the difference in peripheral speed at the sliding contact position in response to variation in rotational speed of the fixing belt with ease.

Also, the fixing device may further include a driving unit that drives the meandering prevention members to rotate in accordance with rotation of the fixing belt. While the meandering prevention members are driven to rotate by a force of friction with the fixing belt, load is put on the fixing belt due to the friction. In order to prevent deformation, fatigue, and so on of the fixing belt resulting from the load put on the fixing belt, it is effective to separately drive the meandering prevention members to rotate.

In this case, the driving unit desirably includes: a detection subunit that detects a rotational speed of the fixing belt; and a speed adjustment subunit that adjusts a rotational speed of the meandering prevention members in accordance with the rotational speed of the fixing belt detected by the detection subunit.

Also, the power feeding members are each preferably provided, such that, when seen in the rotation axis direction of the fixing roller, the power feeding member is positioned in a region that is immediately upstream of the fixing nip among four regions partitioned by a first straight line and a second straight line, where the first straight line passes through a rotation center of the fixing roller and the center of the fixing nip in the rotational direction of the fixing roller, and the second straight line passes through the rotation center of the fixing roller and is perpendicular to the first straight line. With this structure, it is possible to reduce the mechanical load applied on the fixing belt due to abutment with the power feeding members, and stabilize the contact state between the power feeding members and the fixing belt.

The image forming apparatus relating to the present invention includes the fixing device relating to the present invention. With this structure, the image forming apparatus relating to the present invention exhibits the above effects which are exhibited by the fixing device relating to the present invention.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A fixing device comprising:

an endless fixing belt that includes a resistance heating layer that generates Joule heat when electric power is fed thereto and a pair of electrode parts that feed electric power to the resistance heating layer;

a pair of power feeding members that are each in abutment with an outer circumferential surface of a corresponding one of the electrode parts to feed electric power to the resistance heating layer through the electrode part;

a fixing roller that is loosely inserted into the fixing belt;

a pressure member that is in pressure-contact with an outer circumferential surface of the fixing belt to form a fixing nip;

a pair of meandering prevention members that are each provided facing a corresponding one of sides of the fixing belt in a width direction of the fixing belt, and prevent the fixing belt from meandering in the width direction; and a pair of prevention member holders that each hold a corresponding one of the meandering prevention members, such that the meandering prevention member rotates independently from the fixing roller, wherein the meandering prevention members are each held so as to have a rotation center positioned inside a circle, where, when seen in a rotation axis direction of the fixing roller, the circle has a center coincident with a midpoint between two focal points of an ellipse approximating a belt rotation path of the fixing belt, and has a radius equal to a distance from the center of the circle to a straight line passing through a rotation center of the fixing roller and a center of the fixing nip in a rotational direction of the fixing roller.

2. The fixing device of claim 1, wherein the meandering prevention members are each held so as to have the rotation center that is coincident with the center of the circle.

3. The fixing device of claim 2, wherein when seen in the rotation axis direction of the fixing roller, the ellipse approximating the belt rotation path of the fixing belt is included in a circle enclosing the belt rotation path, and includes therein a circle within the belt rotation path.

4. The fixing device of claim 1, wherein the meandering prevention members are each held, such that, in a diameter direction thereof in a plane perpendicular to a rotation axis thereof, the rotation axis is positioned equally distant from the nip and from an outermost circumference thereof that is in abutment with the fixing belt.

5. The fixing device of claim 1, further comprising a housing that houses therein the fixing belt, the power feeding members, the fixing roller, the pressure member, the meandering prevention members, and the prevention member holders, wherein the prevention member holders are fastened to an inner wall of the housing, and the prevention member holders rotatably hold the fixing roller via a bearing, and each rotatably hold the corresponding meandering prevention member via a bearing.

6. The fixing device of claim 1, wherein the meandering prevention members each have an outer circular circumference, and the prevention member holders each hold the corresponding meandering prevention member by bringing three or more rollers into abutment with the outer circular circumference of the meandering prevention member.

7. The fixing device of claim 1, wherein the meandering prevention members are in sliding contact with the fixing belt so as to be driven by the fixing belt to rotate.

8. The fixing device of claim 1, further comprising a driving unit that drives the meandering prevention members to rotate in accordance with rotation of the fixing belt.

9. The fixing device of claim 8, wherein the driving unit includes:

a detection subunit that detects a rotational speed of the fixing belt; and a speed adjustment subunit that adjusts a rotational speed of the meandering prevention members in accordance with the rotational speed of the fixing belt detected by the detection subunit.

10. The fixing device of claim 1, wherein the power feeding members are each provided, such that, when seen in the rotation axis direction of the fixing roller, the power feeding member is positioned in a region that is immediately upstream of the fixing nip among four regions partitioned by a first straight line and a second straight line, where the first straight line passes through a rotation center of the fixing roller and the center of the fixing nip in the rotational direction of the fixing roller, and the second straight line passes through the rotation center of the fixing roller and is perpendicular to the first straight line.

11. An image forming apparatus comprising a fixing device, the fixing device comprising:

an endless fixing belt that includes a resistance heating layer that generates Joule heat when electric power is fed thereto and a pair of electrode parts that feed electric power to the resistance heating layer;

a pair of power feeding members that are each in abutment with an outer circumferential surface of a corresponding one of the electrode parts to feed electric power to the resistance heating layer through the electrode part;

a fixing roller that is loosely inserted into the fixing belt;

a pressure member that is in pressure-contact with an outer circumferential surface of the fixing belt to form a fixing nip;

a pair of meandering prevention members that are each provided facing a corresponding one of sides of the fixing belt in a width direction of the fixing belt, and prevent the fixing belt from meandering in the width direction; and a pair of prevention member holders that each hold a corresponding one of the meandering prevention members, such that the meandering prevention member rotates independently from the fixing roller, wherein the meandering prevention members are each held so as to have a rotation center positioned inside a circle, where, when seen in a rotation axis direction of the fixing roller, the circle has a center coincident with a midpoint between two focal points of an ellipse approximating a belt rotation path of the fixing belt, and has a radius equal to a distance from the center of the circle to a straight line passing through a rotation center of the fixing roller and a center of the fixing nip in a rotational direction of the fixing roller.

* * * * *